US010000960B2

(12) United States Patent
Angiuli et al.

(10) Patent No.: US 10,000,960 B2
(45) Date of Patent: Jun. 19, 2018

(54) DRIVE DEVICE FOR A MOVABLE BARRIER

(71) Applicants: Ralph Carl Angiuli, Canfield, OH (US); Bradley Lee Lightner, North Canton, OH (US); Mark Adam Bullock, Wooster, OH (US)

(72) Inventors: Ralph Carl Angiuli, Canfield, OH (US); Bradley Lee Lightner, North Canton, OH (US); Mark Adam Bullock, Wooster, OH (US)

(73) Assignee: RMB Systems, LLC, Canfield, OH (US)

( * ) Notice: Subject to any disclaimer, the term of this patent is extended or adjusted under 35 U.S.C. 154(b) by 31 days.

(21) Appl. No.: 15/224,572

(22) Filed: Jul. 31, 2016

(65) Prior Publication Data

US 2017/0037671 A1 Feb. 9, 2017

Related U.S. Application Data

(60) Provisional application No. 62/200,893, filed on Aug. 4, 2015.

(51) Int. Cl.
*E05F 15/00* (2015.01)
*E05F 15/686* (2015.01)
(Continued)

(52) U.S. Cl.
CPC ..... *E05F 15/686* (2015.01); *E05D 13/1215* (2013.01); *E05D 15/24* (2013.01);
(Continued)

(58) Field of Classification Search
CPC .. E05F 15/686; E05F 15/681; E05D 13/1215; E05D 13/10; E05Y 2201/216; E05Y 2900/106
(Continued)

(56) References Cited

U.S. PATENT DOCUMENTS 2,020,831 A * 11/1935 Greegor ..... E05D 13/1261 16/198
2,099,191 A * 11/1937 Blodgett ..... E05D 15/244 16/104
(Continued)

OTHER PUBLICATIONS

Blaine R. Copenheaver, ISA Written Opinion of PCT International Application PCT/US2016/044936, pp. 1-17.

*Primary Examiner* — Katherine W Mitchell
*Assistant Examiner* — Johnnie A. Shablack

(57) ABSTRACT

An operator for moving a barrier between closed and open positions mounted on, or close to, the counterbalance for said barrier. The operator is connected to the counterbalance shaft and lifts the barrier by rotating the counterbalance shaft with attached cable drums and thereby takes up cable connected to the bottom of the door. There is an upper cable connected to the top of the door through a cable drum in the operator. A power spring biases the operator cable drum to always take up the upper cable, keeping it wound. The operator cable drum is connected to the motor through a clutch which when engaged allows the operator to pull the door closed. While the door is closing the clutch can be disengaged to allow the operator cable drum to take up and then pay out the upper cable connected to the top of the door as needed.

12 Claims, 30 Drawing Sheets

(51) Int. Cl.
*E05F 15/40* (2015.01)
*E05D 13/00* (2006.01)
*E05D 15/24* (2006.01)

(52) U.S. Cl.
CPC ..... *E05F 15/40* (2015.01); *E05Y 2201/216* (2013.01); *E05Y 2400/32* (2013.01); *E05Y 2900/106* (2013.01)

(58) Field of Classification Search
USPC ..... 160/188, 189, 190
See application file for complete search history.

(56) References Cited

U.S. PATENT DOCUMENTS 2,630,597 A * 3/1953 Robinson ..... E05D 13/1261 16/198
2,882,044 A * 4/1959 Ginte ..... E05F 15/686 160/189
3,147,001 A * 9/1964 Purdy ..... E05F 15/686 104/210
3,364,974 A * 1/1968 Wiegand ..... E05F 15/686 160/188
3,921,761 A * 11/1975 Votroubek ..... E05D 13/1261 160/191
4,191,237 A 3/1980 Voege
4,472,910 A 9/1984 Iha
4,597,428 A * 7/1986 Iha ..... E05F 15/686 160/188
4,860,813 A 8/1989 Ballyns
5,341,597 A 8/1994 Stoltenberg
5,698,073 A 12/1997 Vincenzi
5,743,046 A 4/1998 Siegler
5,803,149 A 9/1998 Halley
5,931,212 A 8/1999 Mullet
6,250,360 B1 * 6/2001 Ochoa ..... E05D 15/24 16/96 R
6,253,824 B1 7/2001 Mullet
6,257,303 B1 * 7/2001 Coubray ..... F16H 19/04 160/188
6,276,744 B1 8/2001 Huber
6,325,134 B1 12/2001 Mullet
6,326,751 B1 12/2001 Mullet
6,329,931 B1 12/2001 Gunton
6,374,543 B1 * 4/2002 Bishai ..... E05F 15/684 49/197
6,401,792 B1 6/2002 Mullet
6,561,255 B1 5/2003 Mullet
6,561,256 B2 * 5/2003 Mullet ..... E05D 13/1215 160/191
6,568,454 B1 5/2003 Mullet
6,588,156 B2 7/2003 Mullet
6,667,591 B2 12/2003 Mullet
6,696,806 B2 2/2004 Study
6,719,033 B2 4/2004 Stoltenberg
6,739,372 B2 5/2004 Mullet
6,742,564 B2 * 6/2004 Martin ..... E05D 13/1261 160/188
6,782,662 B2 8/2004 McCartney
6,845,804 B2 1/2005 Mullet
6,851,465 B2 2/2005 Mullet
6,880,609 B2 4/2005 Mullet
6,883,579 B2 4/2005 Olmsted
6,983,785 B2 * 1/2006 Altimore ..... E05D 13/1238 16/72
7,005,884 B2 2/2006 Gunton
7,061,197 B1 6/2006 Mullet
7,143,804 B2 12/2006 Mullet
7,173,516 B2 2/2007 Mullet
7,207,142 B2 4/2007 Mullet
7,246,647 B2 7/2007 Mullet
7,260,917 B2 8/2007 Brookbank
7,282,883 B2 10/2007 Mullet
7,315,143 B2 1/2008 Mullet
7,333,308 B2 2/2008 Gunton
7,355,363 B2 * 4/2008 Angiuli ..... E05F 15/603 318/286
7,358,480 B2 4/2008 Mullet
7,367,160 B2 5/2008 Mullet
7,372,225 B2 5/2008 Murphy
7,418,800 B1 9/2008 Sellman
7,432,676 B2 10/2008 Keller
7,437,971 B2 10/2008 Gunton
7,521,881 B2 4/2009 VanDrunen
7,525,267 B2 * 4/2009 Angiuli ..... E05F 15/603 318/282
7,537,042 B2 * 5/2009 Altimore ..... E05D 13/1238 16/72
7,576,504 B2 8/2009 Mullet
7,600,344 B2 10/2009 Michaud
7,607,263 B2 10/2009 Mullet
7,633,253 B2 12/2009 Gunton
7,686,061 B2 3/2010 Mullet
7,717,155 B2 5/2010 Mullet
7,980,151 B2 7/2011 Hormann
7,997,324 B2 8/2011 Olmsted
8,033,374 B2 10/2011 Gunton
8,113,263 B2 2/2012 Reed
8,115,438 B2 2/2012 Gunton
8,182,381 B2 5/2012 Gunton
8,375,635 B2 2/2013 Hellinga
8,384,557 B2 2/2013 Gunton
8,495,834 B2 7/2013 Harlow
8,528,622 B2 * 9/2013 Ehrlich ..... E05D 13/1261 160/191
8,866,583 B2 10/2014 Ordaz
8,935,883 B2 * 1/2015 Coubray ..... E05F 15/67 160/188
9,217,283 B2 * 12/2015 Olmsted ..... E06B 9/80
9,234,377 B2 1/2016 Schatz
9,359,802 B2 * 6/2016 James ..... E05D 15/262
9,487,984 B2 * 11/2016 Wachtell ..... E05D 13/1261
2003/0209333 A1 * 11/2003 Olmsted ..... E05D 13/00 160/189
2005/0235563 A1 * 10/2005 Mullet ..... E05D 13/1261 49/200
2006/0090861 A1 * 5/2006 Wu ..... E05F 15/686 160/188
2007/0256797 A1 * 11/2007 Orton ..... E05F 15/681 160/188
2009/0178339 A1 * 7/2009 Kicher ..... E05D 13/12 49/199
2015/0083348 A1 * 3/2015 Szczygielski ..... B60J 5/14 160/190

* cited by examiner

Difference in Travel of Upper Cable Spooled vs. Lower Cable Unspooled as Door Closes
Sidemount Operator, 84" High, 21" (4) Section Door

DRIVE DEVICE FOR A MOVABLE BARRIER

CROSS-REFERENCE

This application claims priority from Provisional Patent Application Ser. No. 62/200,893 filed on Aug. 4, 2015 which is incorporated herein by reference in its entirety.

FIELD OF THE INVENTION

The present invention relates to a drive device for moving a barrier, such as a garage door, between a closed and an open position and vice versa. The device is intended primarily for use with doors of a sectional or one piece design and combined with a counterbalance assembly comprised of a drive shaft connecting cable drums to the door through a flexible linkage. Notwithstanding, other combinations and uses are also contemplated.

BACKGROUND OF THE INVENTION

Jackshaft garage door openers that lift the door by turning the counterbalance shaft have been known by those skilled in the art for quite some time. Jackshaft garage door openers are primarily used on sectional doors with lift clearance, or full vertical, style track configurations since a portion, or all, of the door remains in the vertical orientation when the door is open. When closing, the jackshaft opener turns the counterbalance assembly and winds the counterbalance springs while paying out cable. The door is lowered by the weight of the portion of the door in the generally vertical position, relative to the ground, applying a downward force to the remainder of the door that is in the generally horizontal position, relative to the ground. This downward force also keeps the cables tensioned as the door is closed.

Sectional doors are moveable barriers used to secure an opening in a wall or structure. The opening is usually comprised of a header which is parallel, relative to the ground, spanning the very top of the opening, a floor at the very bottom of the opening which is parallel relative to the ground, and side jambs which are normal, relative to the ground, and span the left and right side of the opening from the floor to the header. The sectional door is in the closed position when the bottom section of the door is in contact with the floor and the entire opening is secured by the sectional door blocking the opening. The sectional door is considered to be in the open position when the very lowest portion, relative to the ground, of the bottom section is near the header of the opening allowing entry and exit through the opening.

On standard lift sectional doors near, or in, the open position, very little of the door, if any, is in the vertical position relative to the ground. Turning the counterbalance assembly to close a standard lift door from near, or at, the open position where insufficient door weight is in the vertical orientation, relative to the ground, leads to a situation where the cables could become un-tensioned and unwrap from the cable drums. Cables which become unwrapped from a cable drum result in an unsafe condition in which the door could drop uncontrollably. A further complication of cables coming unwrapped is the inability to lift the door without binding cables around the counterbalance shaft and potentially breaking the cable and allowing the door to drop to the ground uncontrollably. Cables can also lose tension and unwrap from cable drums in the event a door binds or encounters an obstruction while it is closing.

This could occur not only on standard lift doors, but also on lift clearance and full vertical sectional doors.

Over the years slack cable sensors of various designs have been used to detect a loss of cable tension on sectional doors. These sensors include mechanical and electrical versions all with the same intended purpose, to stop the door from closing when the lift cables are un-tensioned and could potentially unwrap from the cable drums. Electrical versions are connected to inputs on motorized operators to alert the motorized operator that cables are un-tensioned and to stop. Slack cable sensors complicate the installation of a jackshaft opener by requiring additional equipment and installation time. They also cannot prevent the cables from slacking, but rather only detect it.

Standard lift doors can sometimes be modified to increase the amount of force acting in the vertical position when the door is in the open position. Those skilled in the art should be familiar with modifying the horizontal tracks of standard lift doors to provide some vertical lift and/or installing pusher springs on the back of the horizontal tracks to push the door closed for brief amount of travel from the open position. Both of these modifications require additional time and equipment, and should be done only by a highly trained individual. Another method of attempting to provide a closing force to standard lift doors when closing via a jackshaft opener has been the addition of one or more cable drums to the door itself on the counterbalance shaft to take up cables attached to the top section of the door to pull it closed. The problem with this method is that as sectional door is closing from the open to close position the top of the door transitions from the horizontal to the vertical position and the top edge of the door moves closer to and then further away from the cable drums. This creates a situation where the cable drums pulling the door closed take up cable and then have to pay out cable during the closing operation. The counterbalance shaft rotates in only one direction as the door closes and thus does not allow for a cable attached to the top of the door to be taken up and then paid out as the top of the door transitions from the horizontal to the vertical orientation. Several devices have been previously proposed to address this. One such prior art device is disclosed in U.S. Pat. No. 4,191,237 which describes an operator used to rotate a counterbalance assembly with cable drums to take up cable thereby lifting the door and another cable drum on the counterbalance assembly that is used to pull the door closed. In order to address the transitioning of the top section from horizontal to vertical the '237 patent discloses a fixed pulley mounted below the counterbalance assembly and an additional pulley attached to a bracket mounted to the top of the door. These inconvenient modifications require additional cost of equipment and time to install and add undesirable complexity to the door system.

Another mechanism disclosed in U.S. Pat. No. 6,883,579 also includes a cable to pull the door closed. The cable is connected to the top section of the door through an arm bracket at one end and to a cable drum on the counterbalance shaft at the opposite end. The point of attachment of the cable to the arm bracket remains in the horizontal position throughout the opening/closing operation. The modification of the door to add the arm bracket and the need for a longer horizontal length of door track is costly, time consuming to install and, therefore, undesirable.

U.S. Pat. No. 6,326,751 also describes a cable that spans between and connects the top of the door to a cable drum mounted on the door counterbalance shaft. The '751 patent describes attachment of the upper cable to the door utilizing a tension member such as an extension spring. While closing, the top section of the door starts transitioning from a generally horizontal to generally vertical orientation, relative to the ground, at which point the top section of the door begins to move away from the cable drum thereby stretching the extension spring while the door continues to close. The problem with this device is the spring, while flexible enough to allow it to wrap on the drum, is actually trying to pull the door open, not closed once the top section of the door has transitioned from horizontal to vertical. In order for the spring to be flexible enough to wrap on the drum it also cannot provide any significant tensile force to the top of the door when pulling it closed from the open position rendering the application of this device impractical in reality.

Consequently, there is a long felt need in the art for a jackshaft opener that not only opens a door by rotating the counterbalance shaft and cable drums to take up lift cables attached to the bottom of the door, but will also provide a force applied to the door so as to positively drive a door closed without relying on the weight of a portion of the door hanging in the vertical position, relative to the ground, and without relying on the addition of costly equipment or time consuming modification of the door. There is also a long felt need in the art for a jackshaft opener that can directly sense the position of the door so as to determine whether or not the door is moving while the counterbalance assembly is turned so as to detect slack cables without additional equipment or modification of the door. Finally, there is a long felt need in the art for a jackshaft opener that accomplishes all of the forgoing objectives, and that is relatively inexpensive to manufacture and safe and easy to use.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The subject matter disclosed herein, in one aspect thereof, is a jackshaft opener that: (i) positively drives a barrier such as a sectional door closed without relying on the weight of a portion of the barrier hanging in the vertical position, relative to the ground, and without relying on the addition of costly equipment or time consuming modification of the barrier; (ii) provides the user with a jackshaft opener that can directly sense the position of the barrier so as to determine whether or not the barrier is moving while the counterbalance assembly is turned so as to detect slack cables without additional equipment or modification of the barrier; and (iii) secures the barrier from being manual forced opened without additional equipment or modification of the barrier.

The object of this invention is to provide for a new type of jackshaft garage door opener that could be installed on new or existing standard lift doors. In addition to turning the counterbalance assembly to open the door through the doors lift cables this new opener includes an integrated cable drum with an upper cable attached to the top section of the door for pulling the door closed, for at least a portion of the door travel, most critically near the open position where little or no door weight may be hanging in the vertical position. Those skilled in the art will also appreciate the benefits from the ability to apply a downward force to the door in the open position by the jackshaft operator itself without the necessary addition of pusher springs on the door, or modification of the track assembly. A clutch connects the integrated cable drum of the operator to the motor of the operator. A means for engaging and disengaging the clutch is also provided. The operator may engage the clutch allowing the motor to rotate the integrated cable drum pulling the door closed for at least a portion of the door travel and then the clutch may be disengaged allowing the integrated cable drum to be disconnected from the motor of the operator. The clutch may be a wrap spring clutch which is comprised of a helical wound spring that is mounted circumferentially overtop of an input hub on one end and circumferentially overtop of an output hub on the opposite end of the helical wound spring.

A wrap spring clutch transmits torque via an interference fit between the internal diameter of the helical spring and the outside diameter of the input and output hubs it is mounted circumferentially overtop of. A wrap spring also only transmits torque in one direction and acts as an overrunning clutch in the opposite direction. The direction the helical spring is wound determines which way the wrap spring clutch will rotate and engage. Those skilled in the art will also appreciate a tensioning device included as part of the operator, ideally a power spring, which will bias the upper cable to spool onto the integrated cable drum when the clutch is disengaged. This will spool the upper cable onto the integrated cable drum of the operator when the clutch is disengaged, allowing the upper cable to be taken up or paid out from the integrated cable drum as needed as the top section goes from horizontal to vertical and vice versa, in reference to the ground.

Still a further objective of this invention is to provide for two separate sensors utilized to monitor the rotation of both the counterbalance rotation on the door system as well as the rotation of the operator cable drum. While closing, the operator controls can monitor the rotation of the operator cable drum and compare it to the rotation of the counterbalance shaft, which the operator is drivingly connected to, and determine whether or not the door has been hung up or is jammed. This will allow the operator to stop further rotation of the counterbalance shaft thereby un-tensioning the door lift cables and possibly unwrapping them from the doors cable drums. When the door is being opened the operator controls can utilize the feedback from the sensors to determine what type and diameter lift cable drum is being used on the door. This is possible because different types of lift cable drums take up different amounts of cable per rotation. The amount of cable taken up or paid out per rotation of the opener cable drum is fixed and when compared to the rotation of the counterbalance the size and type of lift cable drums can be calculated.

Still a further objective of this invention is to provide for a way to secure the barrier from being manual forced opened without additional equipment or modification of the barrier. With the door in, or near, the closed position a flexible linkage attached to the top of the door and to the jackshaft opener or operator applies a force to the top of the door thereby preventing it from being forced open.

In a preferred embodiment of the present invention is a drive system for moving a sectional door between an open and closed position comprised of a jackshaft opener or operator drivingly connected to a counterbalance shaft comprised of a counterbalance cable drum. Said operator opens said sectional door by rotating said counterbalance cable drum thereby taking up and spooling a lift cable onto said counterbalance cable drum. Said operator closes said sectional door by rotating said counterbalance shaft in the opposite direction thereby paying out and unspooling said lift cable from said counterbalance cable drum allowing the weight of said sectional door to keep said lift cables tensioned. For at least a portion of travel while said operator closes said barrier an upper cable attached to said barrier is taken up and spooled onto an operator cable drum which is drivingly connected through a clutch that is engaged to a motor thereby applying a force along said upper cable to the top section of said sectional door moving said sectional door toward the closed position. While continuing to close, but prior to said sectional door reaching the close position, said clutch is disengaged freeing said operator cable drum from said motor thereby allowing said operator cable drum to pay out and unspool said upper cable from said operator cable drum while said sectional door continues to the closed position. The jackshaft opener of the present invention accomplishes all of the forgoing objectives, as well as others, and is relatively inexpensive to manufacture and safe and easy to use.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

DETAILED DESCRIPTION

Figure 1:
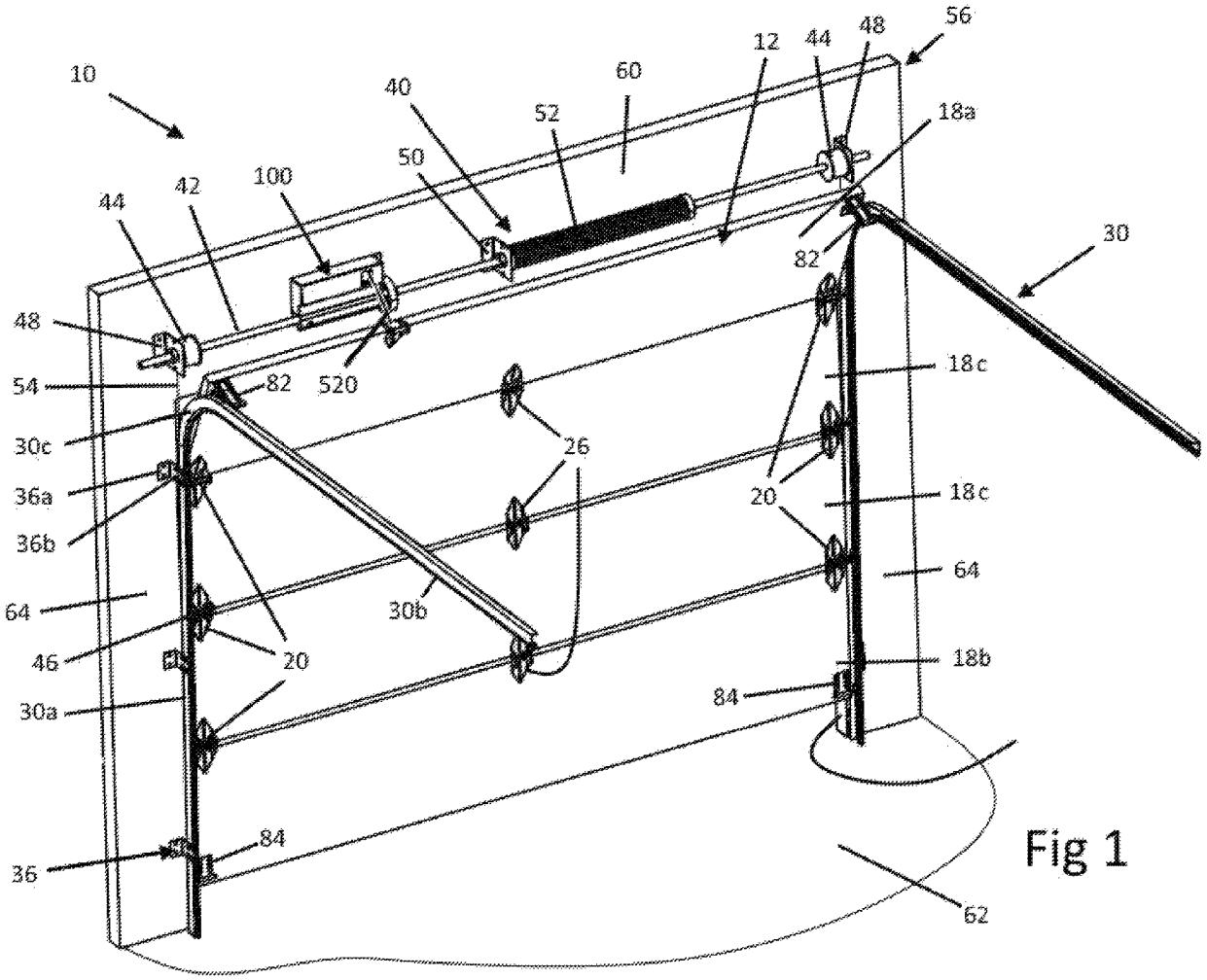
FIG. 1 is a perspective view of a door system with a standard lift sectional door and a drive device of the present invention.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details.

Referring initially to the drawings, FIG. 1 is a perspective view of a frame with a standard lift sectional door and the drive device or drive system of the present invention. A drive system or door system 10 is comprised of a door frame 56, a barrier or standard lift sectional door 12, a track assembly 30, a counterbalance assembly 40, and an operator or motorized operator 100.

Door frame 56 is comprised of an opening 58 which is formed by a header 60 spanning the top of the opening 58, a jamb 64 positioned on both the left and right side of opening 58, and a floor 62 which spans the bottom of opening 58. Typically wood, or other acceptable construction materials, are used to rigidly construct header 60 and jambs 64.

Sectional door 12 is comprised of an upper door section 18*a*, a lower door section 18*b*, and one or more of a center door section 18*c* connected to one another by at least one or more of a center hinge 26 and an end hinge 20 positioned at each end of said sectional door 12. An upper bracket 82 is attached to upper door section 18*a* near the left and right side and a bottom bracket 84 is attached to said lower door section 18*b* near the left and right side.

Track assembly 30 is comprised of a vertical track 30*a*, a horizontal track 30*b*, and a curved track 30*c* mounted to the left and right side of opening 58. A flag bracket 36 is used in multiple locations to attach the vertical tracks 30*a* to the jamb. Each flag bracket 36 is comprised of a jamb leg 36*a*, attached to the jambs 64, and a track leg 36*b* extending perpendicularly to the jamb 64 to which the vertical track 30*a* is attached. Curved track 30*c* extends from the vertical track 30*a* up, relative to the floor 62, and around a curved path into a horizontal orientation, generally parallel to floor 62, and is then connected to the horizontal track 30*b*.

Figure 9:
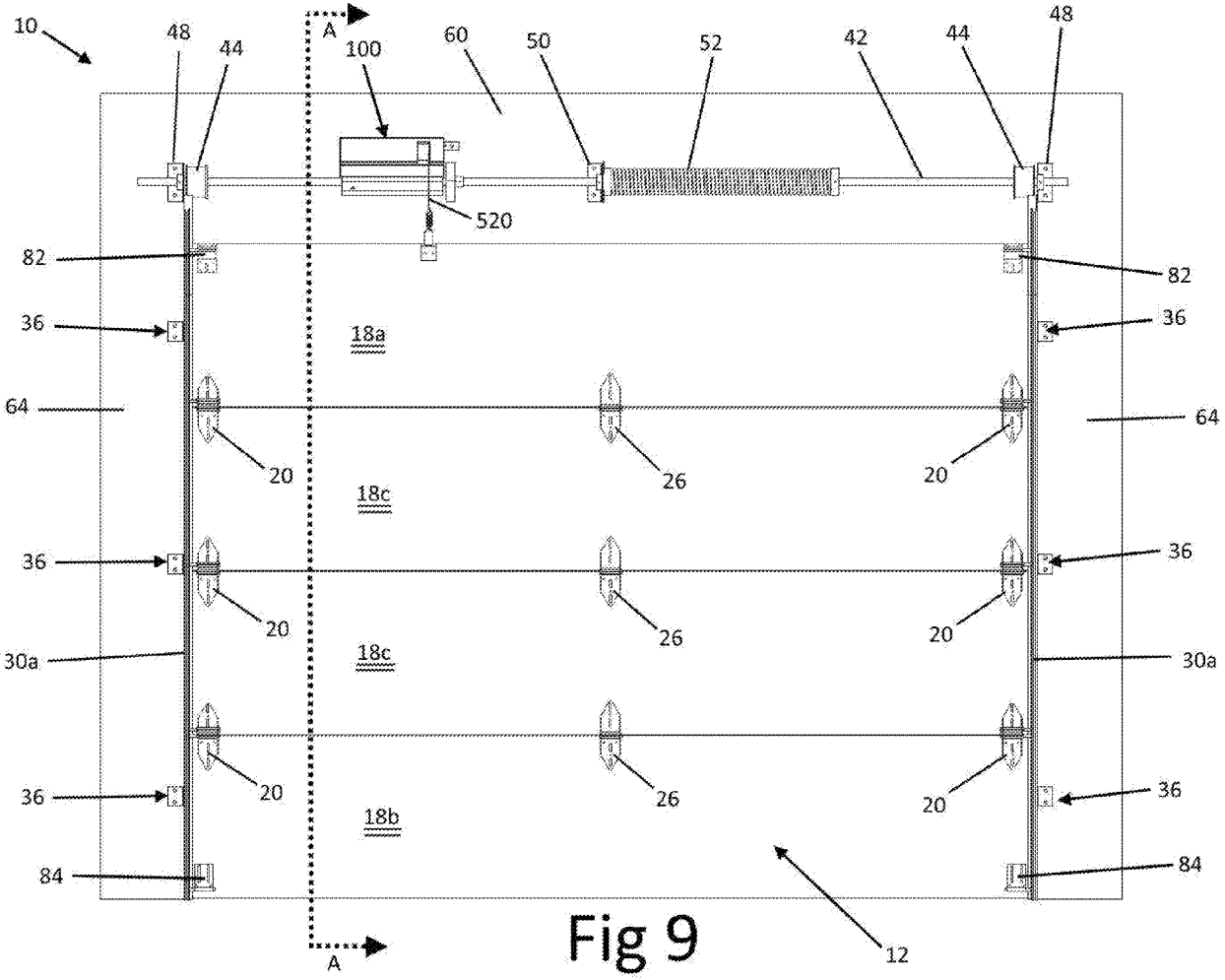
FIG. 9 is a rear elevational view of a door system with a standard lift sectional door in the closed position and the drive device of the present invention.

Referring to FIG. 9 sectional door 12 is movably attached to and positioned between track assembly 30 using a roller assembly 46 attached to each end hinge 20, upper bracket 82, and bottom bracket 84. Track assembly 30 constrains the roller assemblies 46 to travel a predetermined path which allows sectional door 12 to travel between a closed and open position.

Counterbalance assembly 40 is comprised of a counterbalance shaft or door shaft 42 which is mounted to header 60 by way of an end bearing bracket 48 on both ends. A counterbalance flexible linkage storage unit or counterbalance cable drum 44 is supported by, and rotatably coupled to, door shaft 42 at each end. Counterbalance cable drum 44 is positioned in close proximity to the inside of each end bearing bracket 48 relative to the opening 58 as best shown in FIG. 1. As used herein, rotatably coupled means, including without limitation, two rotating bodies which are attached so as to rotate together around a common axis. A first flexible linkage or lift cable 54 is attached to each side of lower door section 18*b* and is spooled over and attached to corresponding counterbalance cable drum 44. A bearing bracket 50 is mounted to header 60 and supports the door shaft 42 along its span between the end bearing brackets 48. A torsion spring 52 is positioned along the door shaft 42 and has one end affixed to the bearing bracket 50 and the other end of torsion spring 52 is pre-tensioned and is then rotatably coupled to the door shaft 42.

Figure 2:
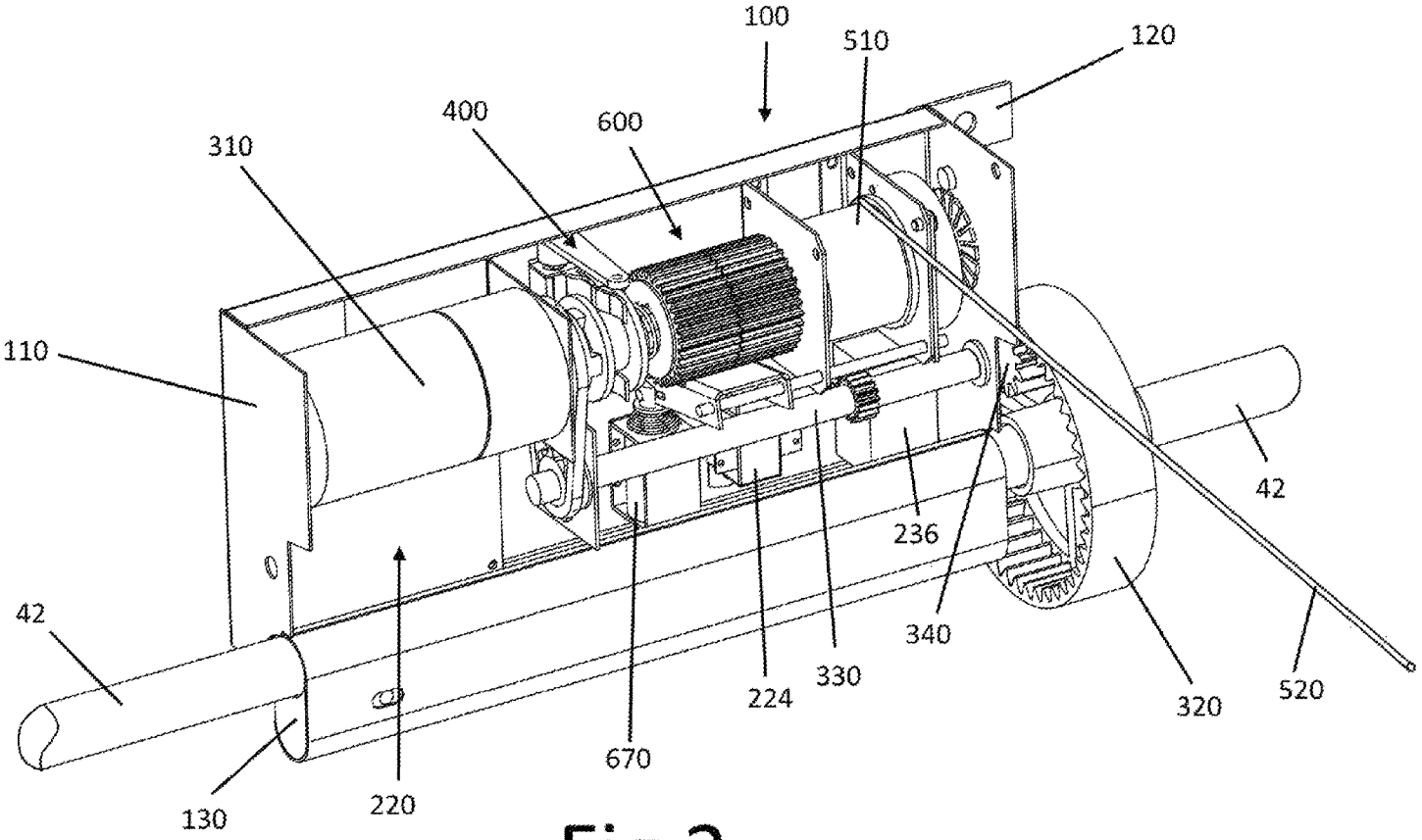
FIG. 2 is a perspective view of the internal components of the drive device of the present invention with the outside cover removed.
Figure 4:
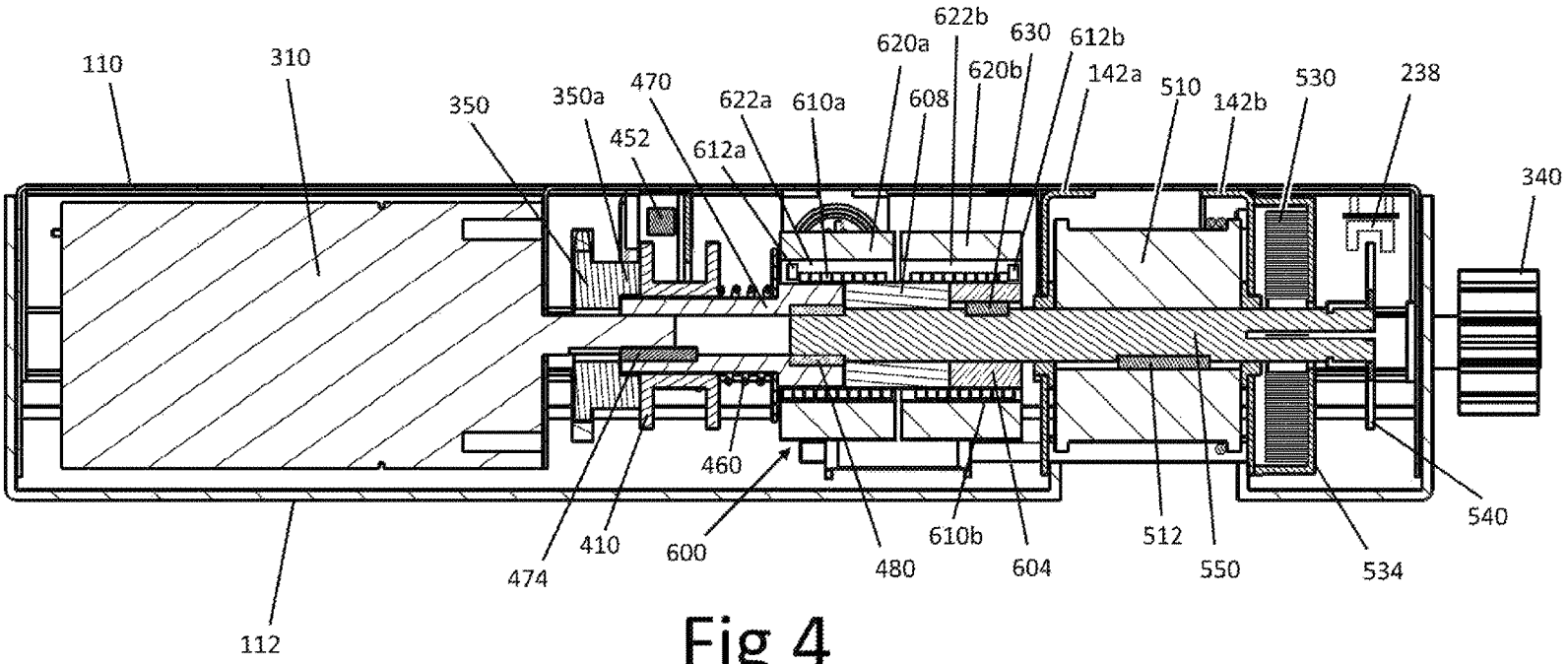
FIG. 4 is a top view of the device of FIG. 3 at cut line 4-4.

Mounted proximate to the door shaft 42 is an operator or motorized operator 100 as seen in FIG. 1. Referring to FIG. 2 an operator frame 110, part of motorized operator 100, is mounted overtop of door shaft 42 and is attached to header 60 through a tab bracket 120. Referring to FIG. 4 a cover 112 is attached to the front of operator frame 100 enclosing the internal components. Referring back to FIG. 2 a drive shaft 330 is supported on one end by a bushing 160 attached to a bracket 170 mounted to frame 100 and is further supported on the opposite end by another bushing 160 attached to a hole in the side of frame 110. Drive shaft 330 extends out one side of operator frame 110 and has a drive gear 340 rotatably coupled. A split hub driven gear 320 is mounted around door shaft 42 in two pieces and is then rigidly connected together and rotatably coupled to door shaft 42 which is then drivingly connected to drive gear 340 and thereby motorized operator 100. As used herein, drivingly connected means, including without limitation, two bodies connected so as to transfer mechanical power from one body to the other. Opposite the drive shaft 330 side of operator frame 110 a wedge bearing 130 is inserted between the door shaft 42 and curved portion of operator frame 110. The wedge bearing 130 is then bolted to operator frame 110. Wedge bearing 130 keeps motorized operator 100 and operator frame 110 in connection to door shaft 42.

Figure 2A:
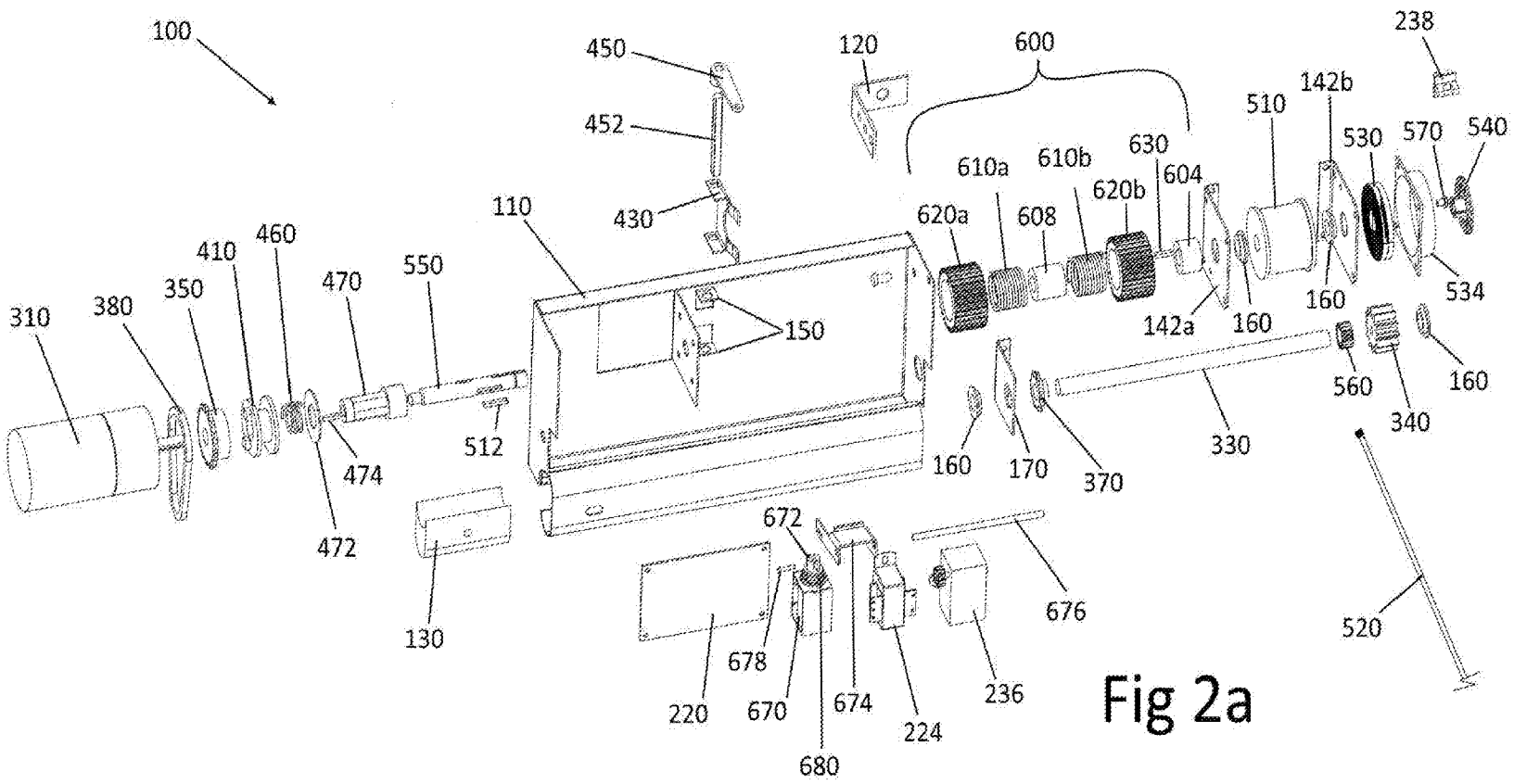
FIG. 2*a* is a perspective and exploded view of the internal components of the drive device of the present invention with the outside cover removed.
Figure 3:
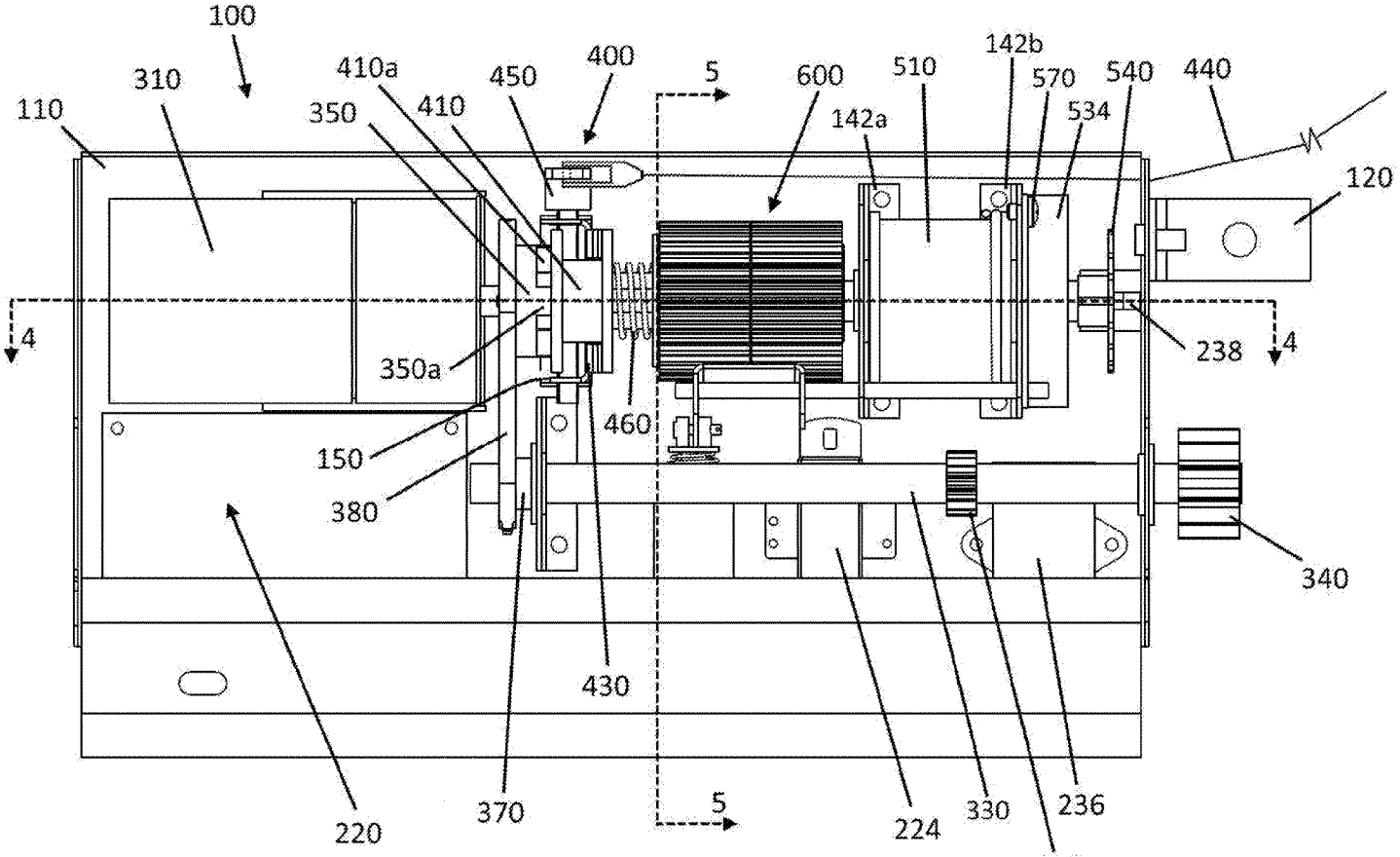
FIG. 3 is a front elevational view of the internal components of the drive device of the present invention with the outside cover removed.

A reversible motor 310 is mounted to operator frame 110 as shown in FIG. 2 and is connected to a driving sprocket 350 through a disconnect mechanism 400 as shown in FIG. 2*a*. Referring to FIG. 2 disconnect mechanism 400 is used to disconnect sectional door 12 from motor 310 so as to manually move the sectional door 12 without power. Referring to FIG. 3 disconnect mechanism 400 is comprised of a slider 410 which is rotatably coupled to, but allowed to translate axially relative to, motor 310. Slider 410 is comprised of a set of dentil teeth 410*a* which engage a corresponding set of dentil teeth 350*a* in driving sprocket 350. A disconnect spring 460 pushes up against a washer 472 and thereby hex shaft 470 and therefore forces slider 410 into engagement with driving sprocket 350. A fork 430 is pivotally attached to operator frame 110 through a set of bent flanges 150 as shown on FIG. 2*a*. Referring to FIG. 3 a disconnect cable 440 is connected to an arm 450 which in turn rotates a square bar 452 thereby rotating fork 430. As tension is applied to a disconnect cable 440, arm 450 turns fork 430 to contact and force slider 410 to compress a disconnect spring 460 while dis-engaging driving sprocket 350 from motor 310 by way of separating dentil teeth 410*a* from dentil teeth 350*a* disconnecting sectional door 12 from motor 310 and thereby allowing sectional door 12 to be moved manually. By releasing tension on disconnect cable 440, disconnect spring 460 is allowed to force slider 410 back into engagement with driving sprocket 350 reengaging dentil teeth 410*a* and dentil teeth 350*a* on driving sprocket 350.

With slider 410 engaged, driving sprocket 350 is rotatably connected to motor 310 and can turn driven sprocket 370 by way of a roller chain 380. Driven sprocket 370 is rotatably coupled to a drive shaft 330 which is rotatably coupled to drive gear 340 that turns driven gear 320 mounted on door shaft 42 for transmitting power to counterbalance cable drums 44 to take up or payout lift cables 54 thereby lifting or lowering sectional door 12.

An operator flexible linkage storage unit or operator cable drum 510, as shown in FIG. 4, is rotatably coupled to a drum shaft 550 which is supported two places by bushing 160 attached to a pair of bushing brackets 142*a* and 142*b* attached to operator frame 110. Operator cable drum 510 and counterbalance cable drum 44 each rotate about a different axis which are spaced apart and generally parallel to each other. A second flexible linkage or upper cable 520 is attached to upper door section 18*a* and is spooled over and attached to said operator cable drum 510. A tensioning device or power spring 530 is attached to drum shaft 550 on one end and is rigidly fixed to a spring cover 534 which is in turn bolted several places by screw 570 to bushing bracket 142*b* as shown in FIG. 3. Power spring 530 may be a multi-rotation spiral wound torsion spring that stores and then releases torque. Operator cable drum 510 is rotatably coupled to the motor 310 through a clutch 600 as shown in FIG. 2. Referring to FIG. 2*a* clutch 600 may be comprised of a wrap spring 610*a*, a wrap spring 610*b*, a center hub 608, a stop collar 620*a* and 620*b*, an end hub 604 and a key 630. Referring to FIG. 4 drum shaft 550 is rotatably coupled to end hub 604 through key 630. Drum shaft 550 then extends through center hub 608 and is received by a hex shaft 470 in a bushing 480. Motor 310 is rotatably coupled to hex shaft 470. As motor 310 turns, hex shaft 470 becomes rotatably coupled to drum shaft 550 in the closing direction of the sectional door 12 by way of wrap spring 610*a* which wraps tight and the inside diameter of wrap spring 610*a* becomes drivingly connected to the outside diameter of center hub 608 which in turn rotates and causes wrap spring 610*b* to wrap tight and the inside diameter of wrap spring 610*b* becomes drivingly connected to the outside diameter of end hub 604 which is then rotatably coupled to drum shaft 550. Drum shaft 550 is rotatably coupled to operator cable drum 510 through a key 512.

Figure 5:
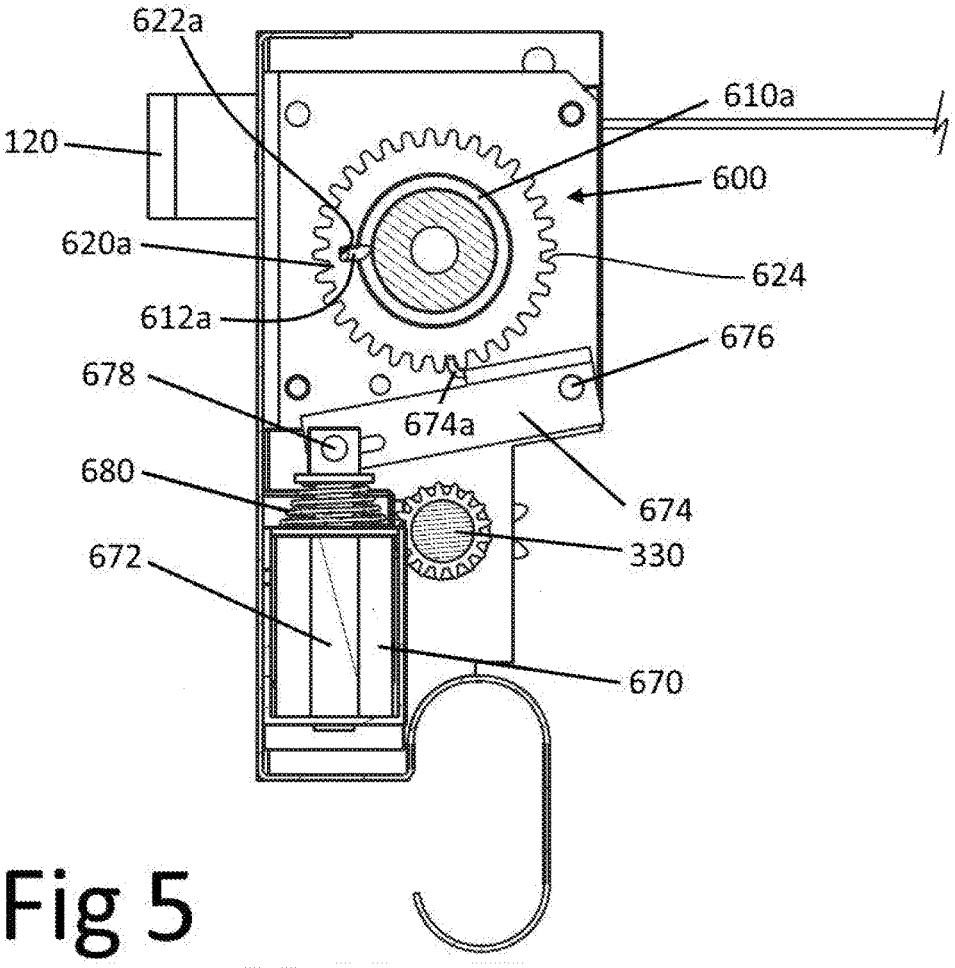
FIG. 5 is a left side view of the device of FIG. 3 at cut line 5-5.

Wrap spring 610*a* is comprised of a bent up tab 612*a* and wrap spring 610*b* is comprised of a bent up tab 612*b* both of said bent up tabs 612*a* and 612*b* are located within a keyway slot 622*a* in a stop collar 620*a*, and a keyway slot 622*b* in stop collar 620*b* respectively. Stop collar 620*a* and 620*b* are located over the outside diameter of wrap spring 610*a* and 610*b* respectively. Referring to FIG. 5 stop collars 620*a*, and 620*b* have a plurality of slots 624 around their circumference. A pivot arm 674 has a blocking tab 674*a* which engages the slots 624 on stop collar 620*a* and 620*b*.

A solenoid coil 670 is mounted proximate to clutch 600. Solenoid coil 670 has an armature 672 which is pulled in longitudinally through solenoid coil 670 against a compression spring 680 and a clevis pin 678 connects armature 672 to pivot arm 674 through a slotted hole which rotates pivot arm 674 about a pin 676 and thereby moves blocking tab 674*a* out of connection with slots in stop collar 620*a* and 620*b*.

Figure 8:
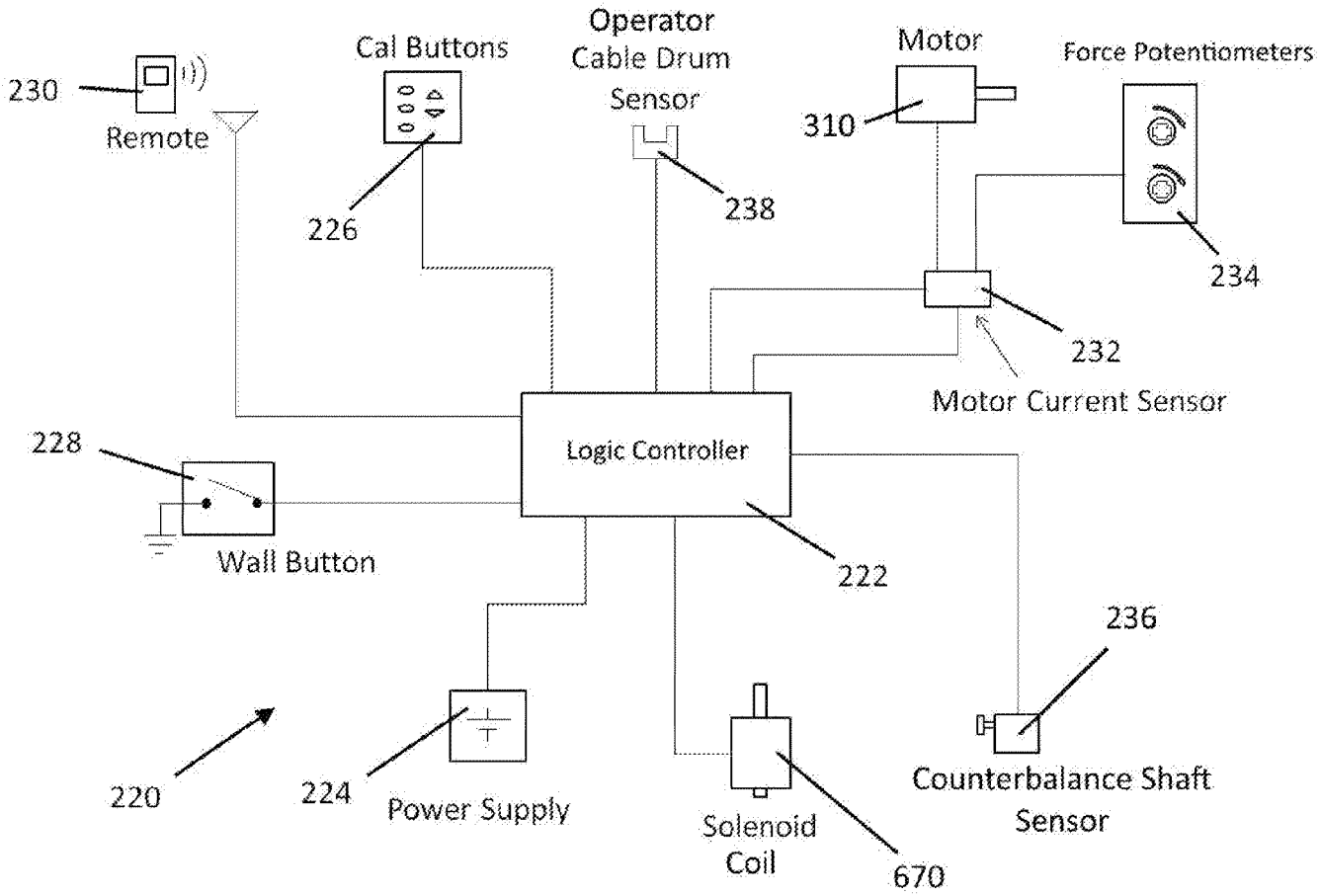
FIG. 8 is a schematic view of the control circuit of the first embodiment of the drive device of the present invention.

In FIG. 8 a schematic view of a control circuit 220 is shown. This is a high level overview and therefore does not show drive circuits, conditioning circuits, shielding, etc. that the completed motorized operator 100 control circuit 220 includes which would be easily understood by those skilled in the art. Motorized operator 100 is comprised of a logic controller 222 which monitors inputs and may utilize programmed logic to control outputs. Logic controller 222 is connected to and is in control of motor 310. A power supply 224 provides power to the logic controller 222 and all of the control circuit 220. A first sensor or counterbalance shaft sensor 236 is connected to drive shaft 330 through a gear 560 which is rotatably coupled to drive shaft 330. Counterbalance shaft sensor 236 always remains in rotatable connection to door shaft 42. By utilizing an absolute encoder for counterbalance shaft sensor 236 sectional door 12 may be moved manually without power applied to control circuit 220. Upon restoration of power logic controller 222 could determine the position of the door shaft 42 and thereby sectional door 12. A second sensor or operator cable drum sensor 238, which may be, but is not limited to, a photo interrupter type sensor, is connected to logic controller 222 and generates pulses as an opto-wheel 540 connected to drum shaft 550 rotates through the optical gap of the operator cable drum sensor 238 as shown in FIG. 4. Logic controller 222 monitors the pulses received from operator cable drum sensor 238. By utilizing a motor current sensor 232 to sense the amount of current being pulled by motor 310 the amount of relative force required to move sectional door 12 can be estimated. The amount of current pulled by motor 310 is directly related to the amount of torque motor 310 is applying to move sectional door 12. While sectional door 12 is closing, logic controller 222 monitors the drive current from a motor current sensor 232. If the monitored drive current exceeds a pre-determined amount then logic controller 222 could initiate a reversal. The pre-determined amount could be field adjustable by using a force potentiometer 234 or some other method known by those skilled in the art. Control circuit 220 is also comprised of a wall button 228 and a remote 230 either of which can be used to initiate the opening or closing of sectional door 12 via motorized operator 100. Control circuit 220 is further comprised of a calibration interface or cal buttons 226 for adjusting the control settings during installation or service.

Having described the general structure of a first embodiment of a new jackshaft opener, and the environment in which it operates, its function will now be described in general terms.

Once motorized operator 100 is mounted to the counterbalance assembly 40 and connected to sectional door 12 the opening and closing limits can be set in logic controller 222. When control circuit 220 is first powered up there are no limits set in the logic controller 222. With sectional door 12 in the closed position a cal button 226 is used to prompt logic controller 222 to record the current position of counterbalance shaft sensor 236 as the down limit. Sectional door 12 is then moved to its desired open position and logic controller 222 is prompted to record the new position as the up limit using cal button 226.

Normal operation of motorized operator 100 is initiated through either a wall button 228 or a remote 230 input to logic controller 222. If sectional door 12 is in, or near, the closed position logic controller 222 receives an open input from either wall button 228 or remote 230, logic controller 222 will leave solenoid coil 670 de-energized and thereby keep pivot arm 674 and blocking tab 674*a* engaged in slots in stop collars 620*a* and 620*b* thereby preventing stop collars 620*a* and 620*b* from rotating. Logic controller 222 then energizes motor 310 in the open direction which turns slider 410 which is engaged in driving sprocket 350 and turns driven sprocket 370 mounted to drive shaft 330 by way of a roller chain 380. The rotation of drive shaft 330 causes drive gear 340 to turn driven gear 320 and door shaft 42 in the open direction which transmits power to counterbalance cable drums 44 to take up lift cables 54 thereby lifting sectional door 12 to the open position. As motorized operator 100 opens sectional door 12 a bent up tab 612*b* on wrap spring 610*b* contacts the wall of keyway slot 622*b* in stop collar 620*b*. Blocking tab 674*a* on pivot arm 674 is engaged in slots 624 preventing stop collar 620*b*, and thereby wrap spring 610*b*, from rotating thereby keeping wrap spring 610*b* loose on the hex shaft 470, and thereby keeping operator cable drum 510 rotatably free from motor 310. Rotatably free means, without limitation, two bodies are free to independently rotate relative to one another about a common axis. During the opening of sectional door 12, power spring 530 keeps upper cable 520 tensioned and spooled on operator cable drum 510. At a pre-determined time or position, which may be determined by counterbalance shaft sensor 236, logic controller 222 de-energizes motor 310 to stop sectional door 12 in the open position.

Figure 10:
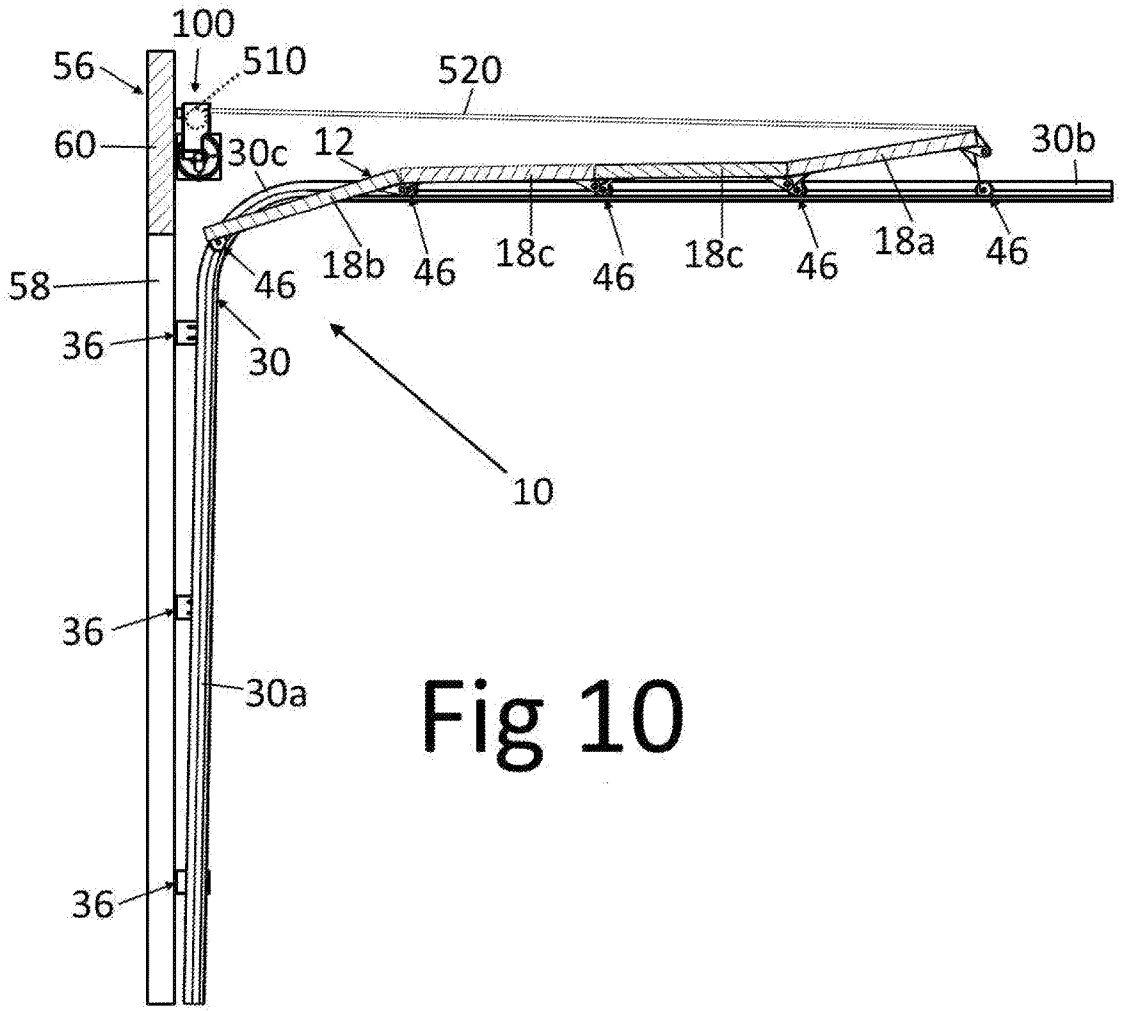
FIG. 10 is a left side view of a door system with a standard lift sectional door in the open position and a drive device of the present invention at cut line A-A depicted in FIG. 9.
Figure 11:
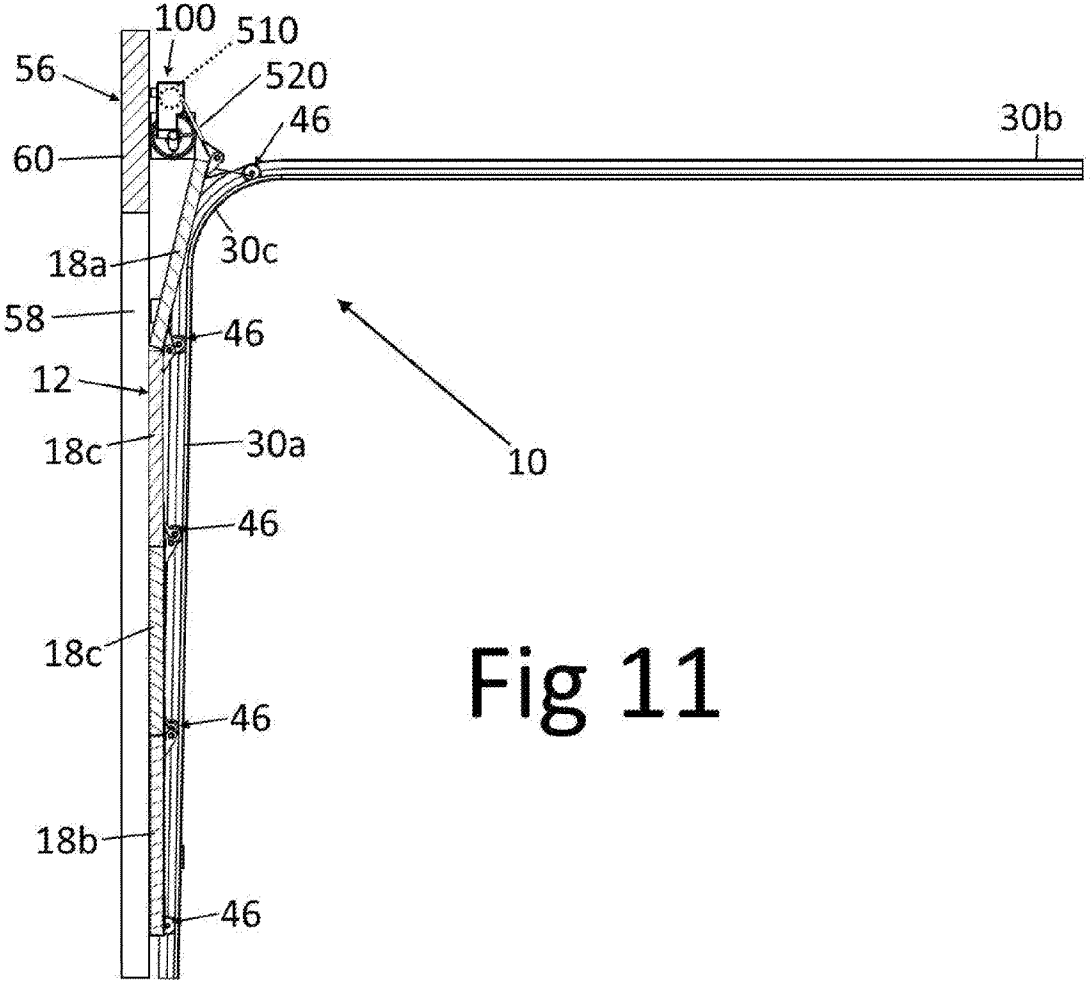
FIG. 11 is a left side view of a door system with a standard lift sectional door in the position of minimum distance between the top section and the drive device of the present invention at cut line A-A depicted in FIG. 9.
Figure 12:
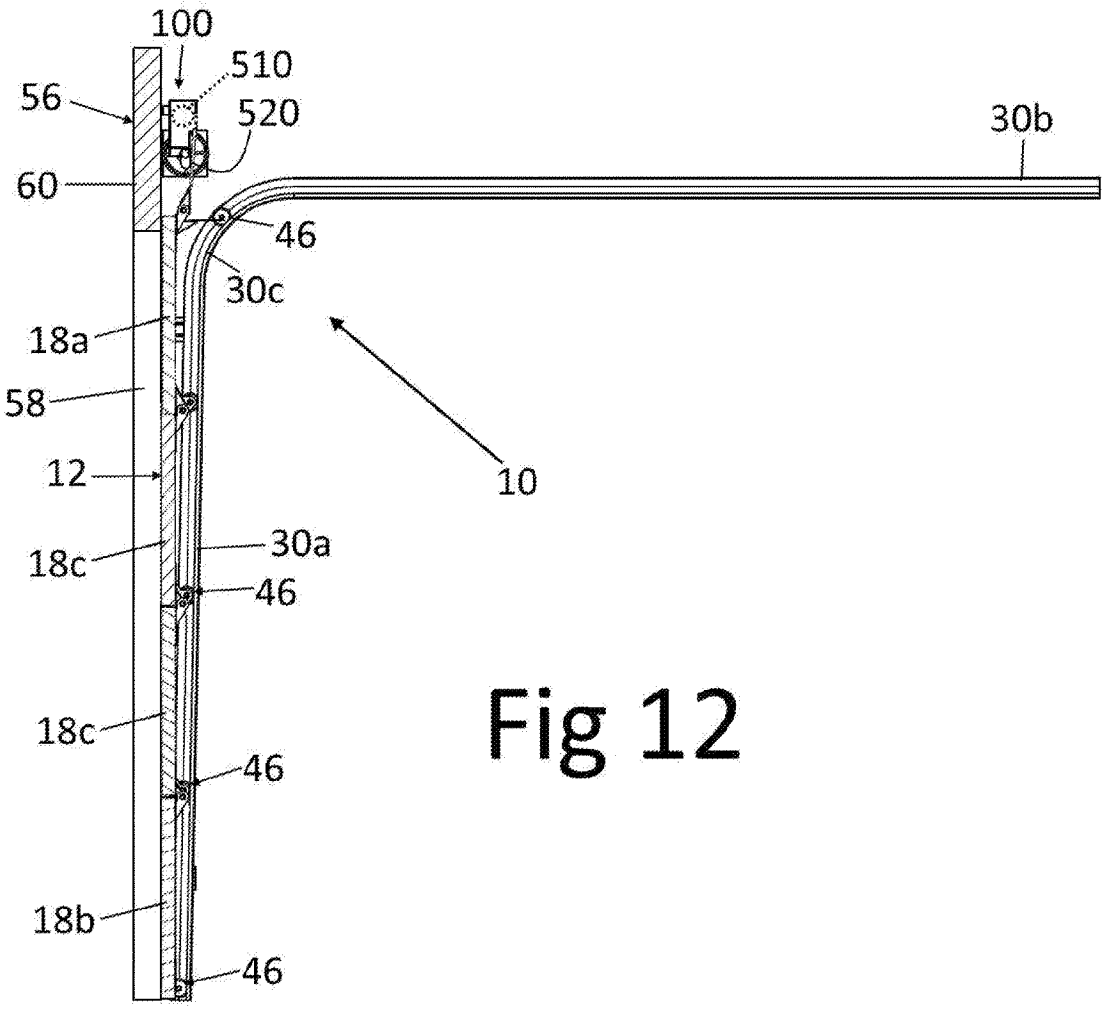
FIG. 12 is a left side view of a door system with a standard lift sectional door in the closed position and a drive device of the present invention at cut line A-A depicted in FIG. 9.
Figure 13:
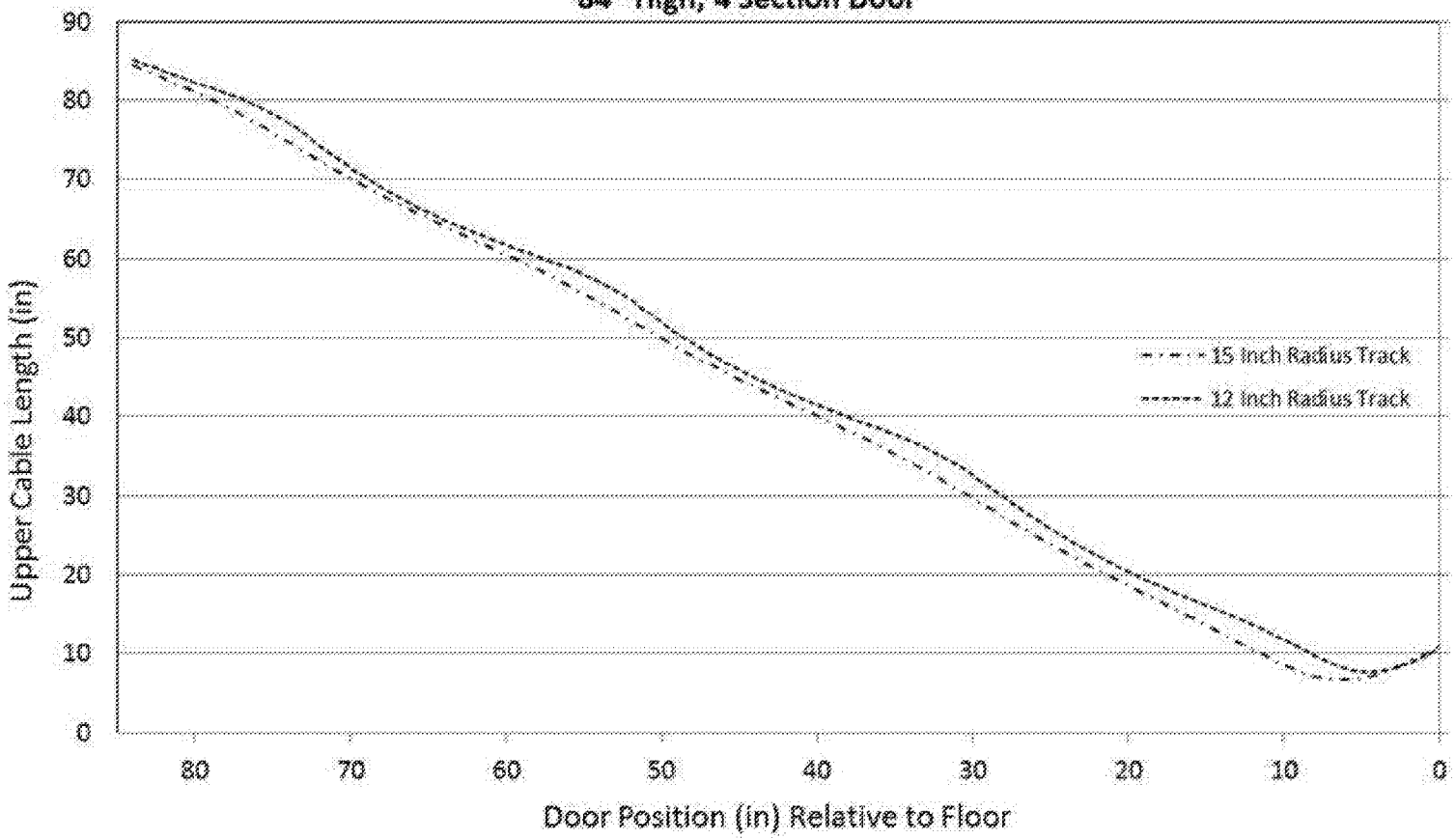
FIG. 13 is a graphical representation of the change in the length of upper cable unspooled from operator cable drum from the first embodiment of the drive device of the present invention over the closing position of a standard lift sectional door.

As sectional door 12 starts to close from the open position, upper cable 520 is taken up on operator cable drum 510 as shown in FIG. 10. As sectional door 12 continues to close and upper door section 18*a* transitions through curved track 30*c*, upper cable 520 reaches a minimum length as shown in FIG. 11. As sectional door 12 continues to close and upper door section 18*a* leaves the curved track 30*c*, upper door section 18*a* moves further away from operator cable drum 510 forcing the length of upper cable 520 unspooled from operator cable drum 510 to increase thereby causing operator cable drum 510 to rotate in the opposite direction and now pay out upper cable 520 as shown in FIG. 12. FIG. 13 provides a graphical representation of the length of upper cable 520 unspooled from operator cable drum 510 during the closing of sectional door 12 from the open to close position.

If sectional door 12 is in or near the open position as shown in FIG. 10, logic controller 222 will engage clutch 600 by energizing solenoid coil 670 thereby pulling in armature 672 against compression spring 680 thereby pulling pivot arm 674 and blocking tab 674*a* out of slots in stop collars 620*a* and 620*b*. Logic controller 222 then energizes motor 310 which rotates slider 410 connectively engaged in driving sprocket 350 and thereby rotates driven sprocket 370 mounted to drive shaft 330 by way of a roller chain 380. Drive shaft 330 rotates causing drive gear 340 to turn driven gear 320 and door shaft 42 which transmits power to wind counterbalance assembly 40 and to rotate counterbalance cable drums 44 and pay-out lift cables 54 thereby allowing sectional door 12 to lower into a closed position. Motor 310 also rotates hex shaft 470 which causes wrap spring 610*a* to be wound tight reducing its inside diameter and thereby drivably connecting hex shaft 470 to center hub 608. Center hub 608 rotates and causes wrap spring 610*b* to be wound tight reducing its inside diameter thereby drivingly connecting center hub 608 to end hub 604 which drivingly rotates drum shaft 550 and connected operator cable drum 510 which takes up and spools upper cable 520 onto operator cable drum 510 thereby applying a force to upper door section 18*a* of sectional door 12 through upper cable 520 thereby pulling sectional door 12 closed. Upper cable 520 continues to pull sectional door 12 closed until a sufficient amount of bottom section 18*b*, and possibly portions of center section 18*c*, have transitioned from a horizontal to a vertical orientation relative to the floor 62 thus allowing the weight of these sections to pull the remainder of sectional door 12 closed as lift cables 54 continue to be paid out. The amount of sectional door 12 needed in the vertical orientation to pull the remainder of sectional door 12 closed will vary from installation to installation.

While sectional door 12 continues to close operator cable drum 510 is drivingly disconnected from motor 310 by disengaging clutch 600 prior to sectional door 12 reaching the position of minimum length of unspooled upper cable 520 shown in FIG. 11. FIG. 11 shows door system 10 and the position of sectional door 12 at the point where upper door section 18*a* is transitioning through curved track 30*c* as sectional door 12 moves to the closed position. Once clutch 600 has been disengaged operator cable drum 510 can pay out upper cable 520 as sectional door 12 reaches the closed position as shown in FIG. 12. Power spring 530 keeps upper cable 520 spooled and tensioned around operator cable drum 510.

To drivingly disconnect operator cable drum 510 from motor 310 clutch 600 is disengaged. Clutch 600 is disengaged by logic controller 222 de-energizing solenoid coil 670 which allows pivot arm 674 and blocking tab 674*a* to re-engage the slots in stop collars 620*a* and 620*b* thereby preventing stop collars 620*a* and 620*b* from rotating. As motor 310 and hex shaft 470 continue to rotate in the closed direction a bent up tab 612*a* on wrap spring 610*a* contacts the wall of keyway slot 622*a* in stop collar 620*a* thereby loosening wrap spring 610*a*, de-coupling hex shaft 470 from center hub 608 and thereby rotatably freeing operator cable drum 510 from motor 310. Power spring 530 continues to apply a torque to drum shaft 550 and connected operator cable drum 510 keeping upper cable 520 tensioned and spooled around operator cable drum 510.

Sectional door 12 continues to close until logic controller 222 determines through counterbalance shaft sensor 236 that the down limit has been reached at which time logic controller 222 de-energizes motor 310, thereby stopping sectional door 12 from further closing. During the closing of sectional door 12 from the open position, logic controller 222 compares pulses received from a operator cable drum sensor 238 to rotations of door shaft 42 through counterbalance shaft sensor 236. If logic controller 222 determines the pulses from operator cable drum sensor 238 have slowed, or stopped, compared to the rotations of door shaft 42 being reported by counterbalance shaft sensor 236 the most likely cause is sectional door 12 is hung up and prevented from closing while motorized operator 100 continues to turn counterbalance assembly 40 paying out lift cables 54 from counterbalance cable drums 44 creating an unsafe condition. If this condition is encountered, then logic controller 222 may de-energize motor 310 thereby stopping sectional door 12 from closing any further, and possibly energize motor 310 in the opposite rotation to reverse sectional door 12 to the open limit, depending on where sectional door 12 stopped in relation to the floor.

With sectional door 12 stopped at the down limit, logic controller 222 could also monitor operator cable drum sensor 238 to determine if sectional door 12 is being forcibly lifted manually without using disconnect mechanism 400. When pulses are detected from operator cable drum sensor 238 without rotation of counterbalance shaft sensor 236, logic controller 222 is able to determine operator cable drum 510 is rotating when door shaft 42 is not. Rotation of operator cable drum 510 without rotation of door shaft 42 is most likely caused by someone trying to forcibly lift sectional door 12 from the closed limit without using disconnect mechanism 400. When motor 310 is not energized and logic controller 222 determines that operator cable drum 510 is rotating while counterbalance shaft sensor 236 is not rotating, logic controller 222 can energize solenoid coil 670 thereby pulling in armature 672 against compression spring 680 pulling pivot arm 674 and blocking tab 674*a* out of slots in stop collars 620*a* and 620*b* thereby rotatably connecting operator cable drum 510 to motor 310 which is non-energized and is non-backdrivable preventing operator cable drum 510 from paying out any additional cable thereby locking sectional door 12 from being forcibly opened further.

Figure 6:
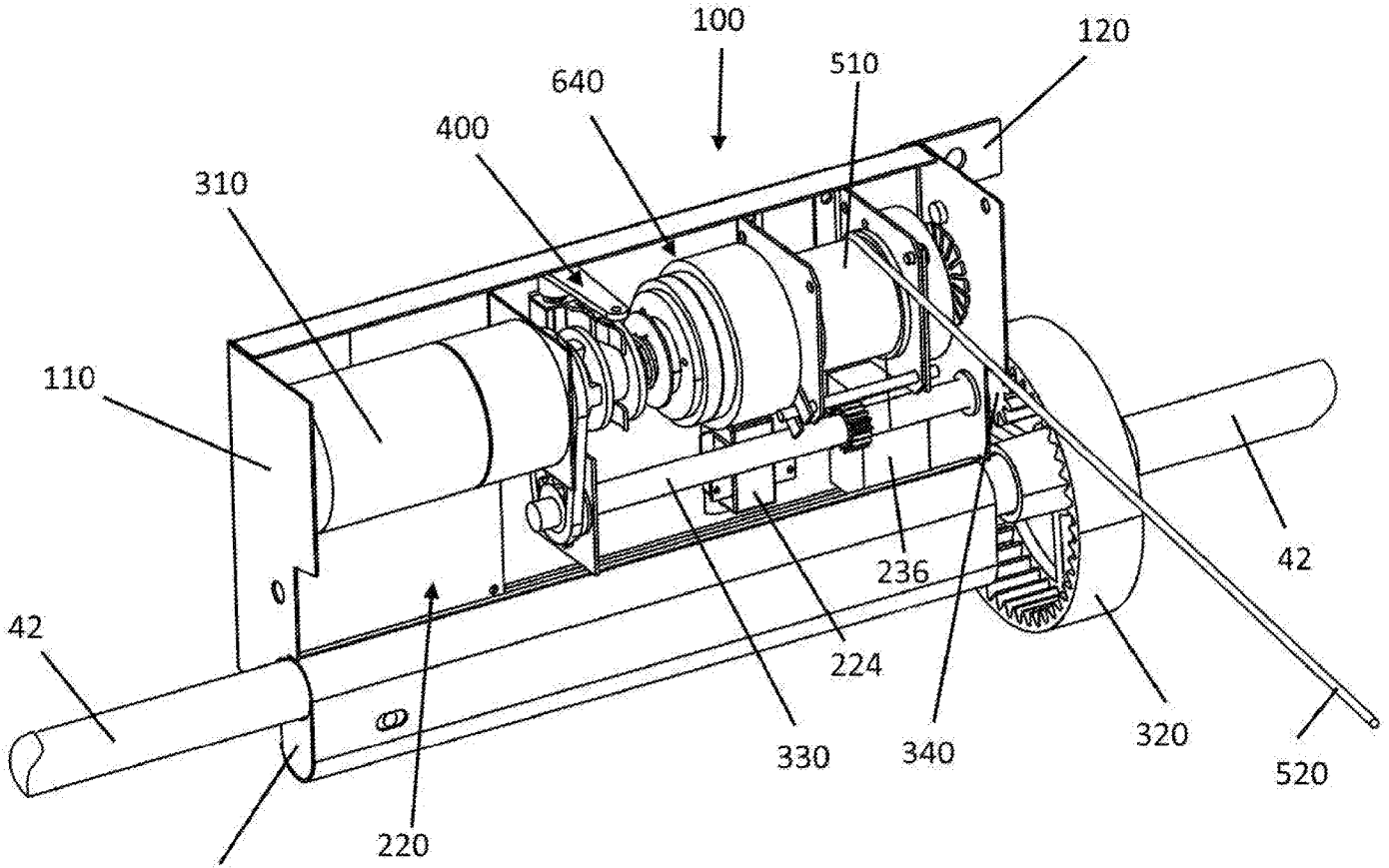
FIG. 6 is a perspective view of an alternate construction of the clutch assembly of the drive device of the present invention.
Figure 6A:
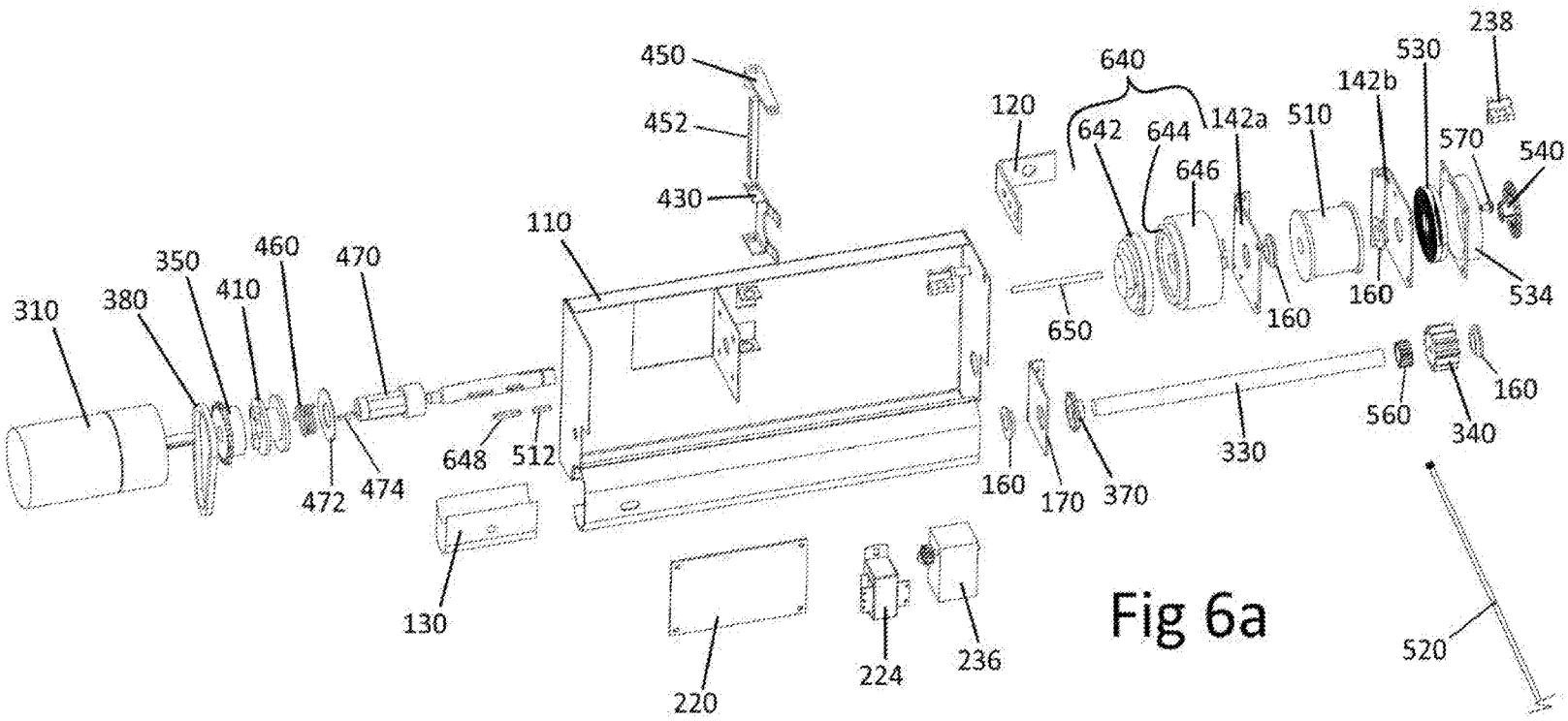
FIG. 6*a* is a perspective and exploded view of the internal components of the alternate construction of the clutch assembly of a drive device of the present invention.
Figure 7:
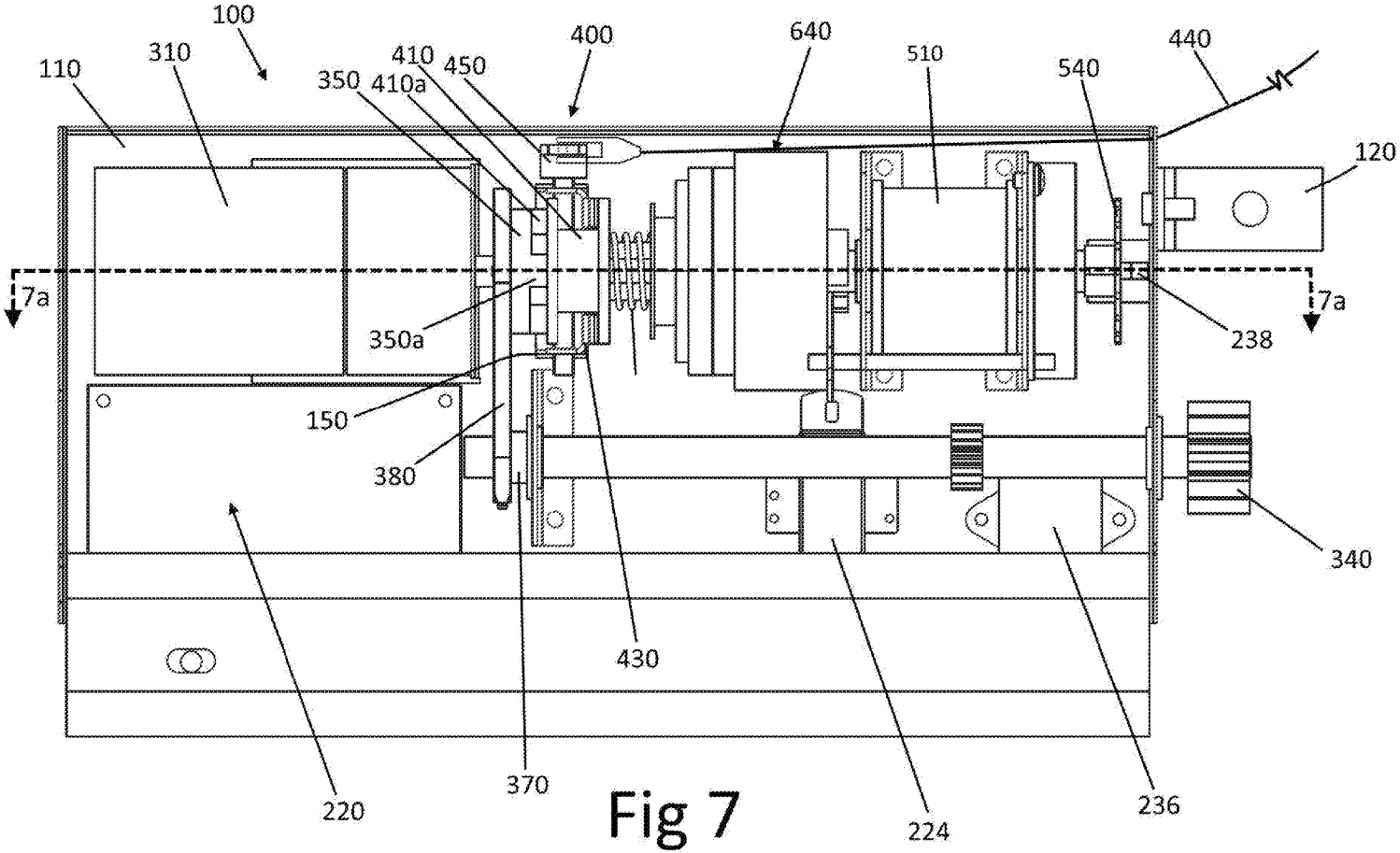
FIG. 7 is a front elevational view of an alternate construction of the clutch assembly of the drive device of the present invention.
Figure 7A:
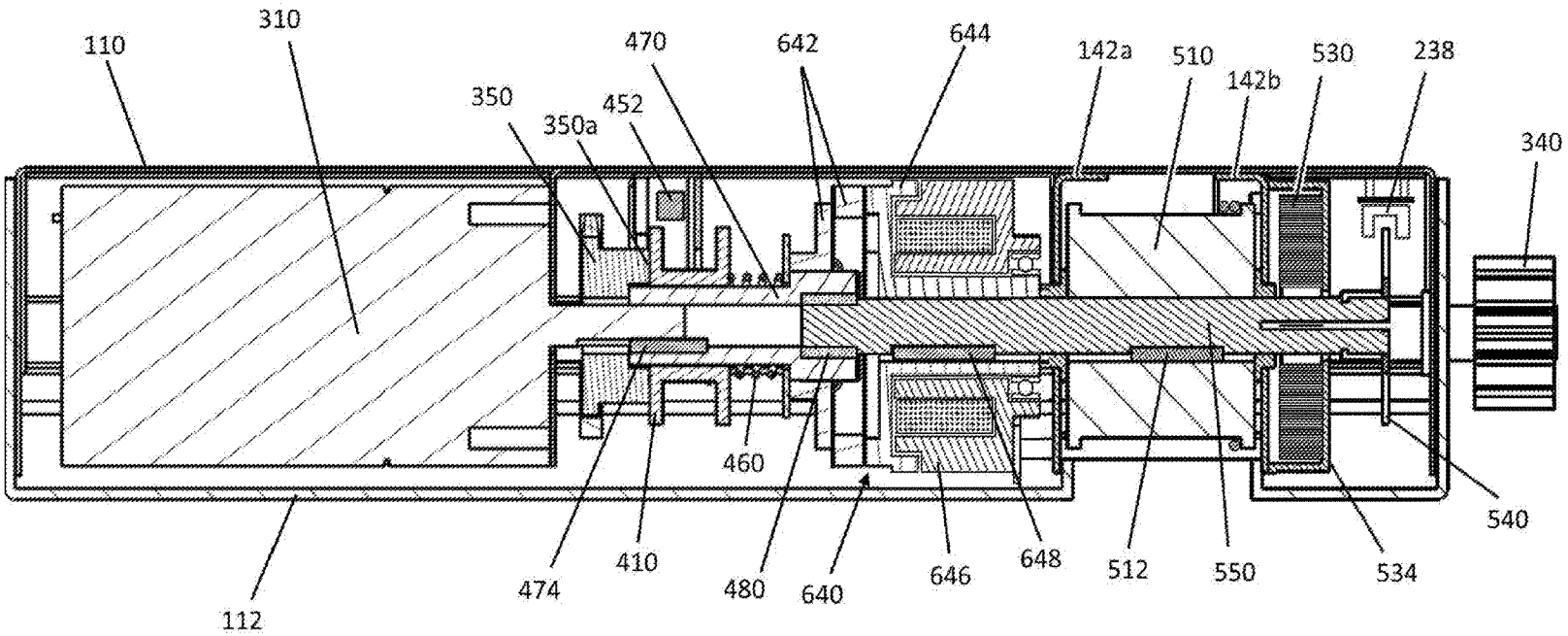
FIG. 7*a* is a top view of the device of FIG. 7 at cut line 7*a*-7*a*.

An alternate construction of the drive system utilizes an electromagnetic clutch 640 to connect motor 310 to the operator cable drum 510. Referring to FIGS. 6 through 7*a*, operator cable drum 510 is rotatably coupled to the motor 310 through an electromagnetic clutch 640. Referring to FIG. 7*a* motor 310 is rotatably coupled to hex shaft 470 by way of a key 474. Hex shaft 470 further wherein rotatably coupled to an armature 642. Upon closing sectional door 12 from a predetermined position at, or near, being open, logic controller 222 energizes a field coil 646 which magnetically draws armature 642 into a rotatably coupled connection with a rotor 644. With the field coil 646 energized and armature 642 and rotor 644 connected, torque can now be transferred from motor 310 through armature 642 and rotor 644 to drum shaft 550 which is rotatably couple to operator cable drum 510 by a key 648 thereby rotating operator cable drum 550 to forcibly drawing in upper cable 520 and pulling sectional door 12 closed. At a pre-determined position, while sectional door 12 continues to close, logic controller 222 de-energizes field coil 646 which allows the armature 642 and rotor 644 to separate and thereby no longer transfer torque from motor 310 to operator cable drum 510. As motor 310 and hex shaft 470 continue to rotate in the closed direction, operator cable drum 510 can rotate freely under tension provided by power spring 530 to keep upper cable 520 spooled and tensioned. As sectional door 12 closes operator cable drum 510 is biased by tensioning device 1506 to take up and spool upper cable 520 as upper door section 18*a* continues to close and approaches, transitions through, and leaves the curved track 30*c*, operator cable drum 510 is able to pay out and unspool upper cable 520 as sectional door 12 reaches the close position. While closing sectional door 12 from the open position to the closed position the length of unspooled upper cable 520 decreases and then increases as shown in FIG. 13. FIG. 13 depicts the unspooled length of upper cable 520 over the closing of sectional door 12 for both a 12 inch and 15 inch radius curved track 30*c*.

Figure 18:
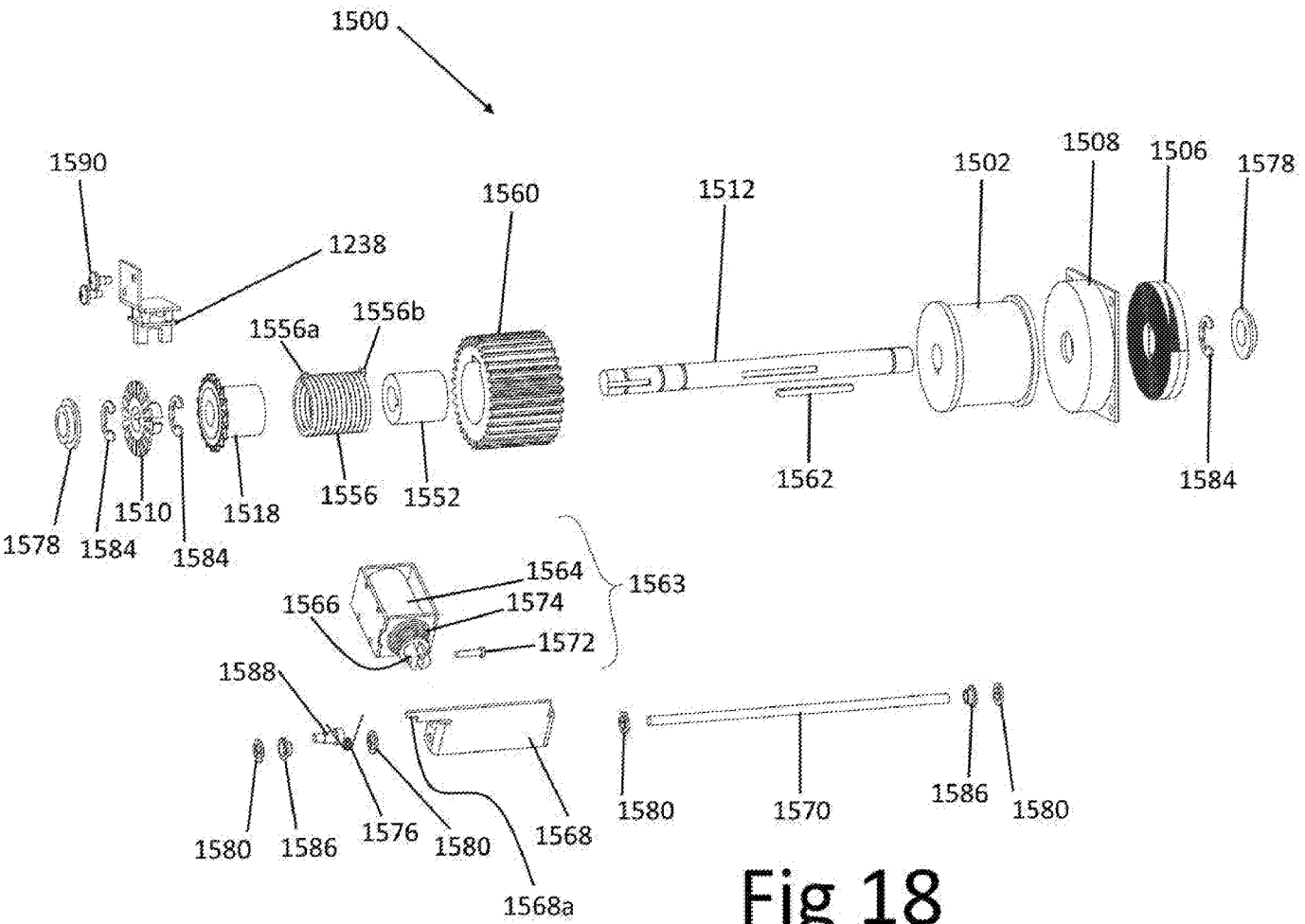
FIG. 18 is a perspective and exploded view of the internal components of the cable drum shaft assembly of a second embodiment of the drive device of the present invention.
Figure 19C:
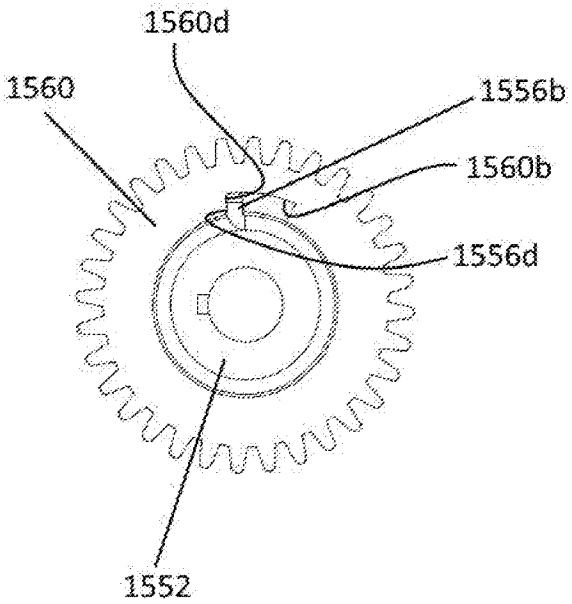
FIG. 19*c* is a right elevational view of a clutch assembly of the second embodiment of the drive device of the present invention.
Figure 19B:
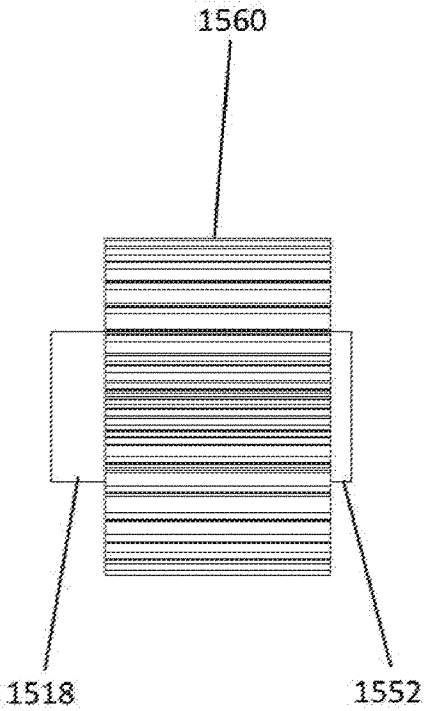
FIG. 19*b* is a front elevational view of a clutch assembly of a second embodiment of the drive device of the present invention.
Figure 19A:
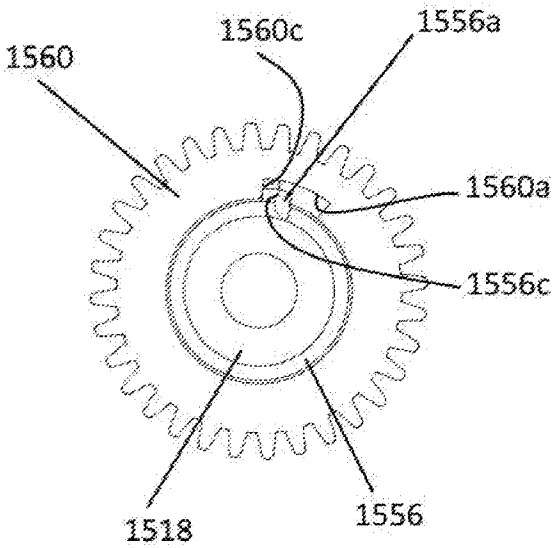
FIG. 19*a* is a left elevational view of a clutch assembly of a second embodiment of the drive device of the present invention.

Further alternative constructions of the drive system may utilize a single wrap spring like a wrap spring 1556 as shown in FIGS. 18, 19*a*, 19*b*, and 19*c* and described in a second embodiment later in this application. Wrap spring 1556 is comprised of a bent up tab 1556*a* on one end and 1556*b* on the opposite end. Wrap spring 1556 may replace wrap spring 610*a* and 610*b* as shown in FIG. 4 and when engaged drivingly connects hex shaft 470 to end hub 604 without requiring center hub 608. Whereas a stop collar 620*a* and 620*b* are required for wrap springs 610*a* and 610*b* respectively wrap spring 1556 requires a only a single stop collar 1560, as shown in FIGS. 19*a*, 19*b*, and 19*c* and which is detailed further in the second embodiment later in this application.

Not illustrated with figures but none the less envisioned as an alternative to the clutch 600, or electromagnetic clutch 640, are different types of mechanical and electro-mechanical clutches which could include a dentil tooth or friction clutch with a mechanical disengagement, a viscous fluid clutch, and roller style one direction overrunning clutches which include some method of engaging and disengaging during the operation of motorized operator 100. Also envisioned are alternative methods to engage and disengage clutch 600. To engage and disengage clutch 600 a motor with a four bar linkage attached to a crank, or a motor with a worm gear and a follower member attached to the driven gear, or an air cylinder may be utilized in place of a solenoid.

Referring to FIGS. 14-26, a second embodiment of the present invention is now described. A drive system or door system 10*a* is comprised of previously described door frame 56, standard lift sectional door 12, track assembly 30, counterbalance assembly 40. Door system 10*a* is also comprised of an operator or motorized operator 1100.

Figure 14:
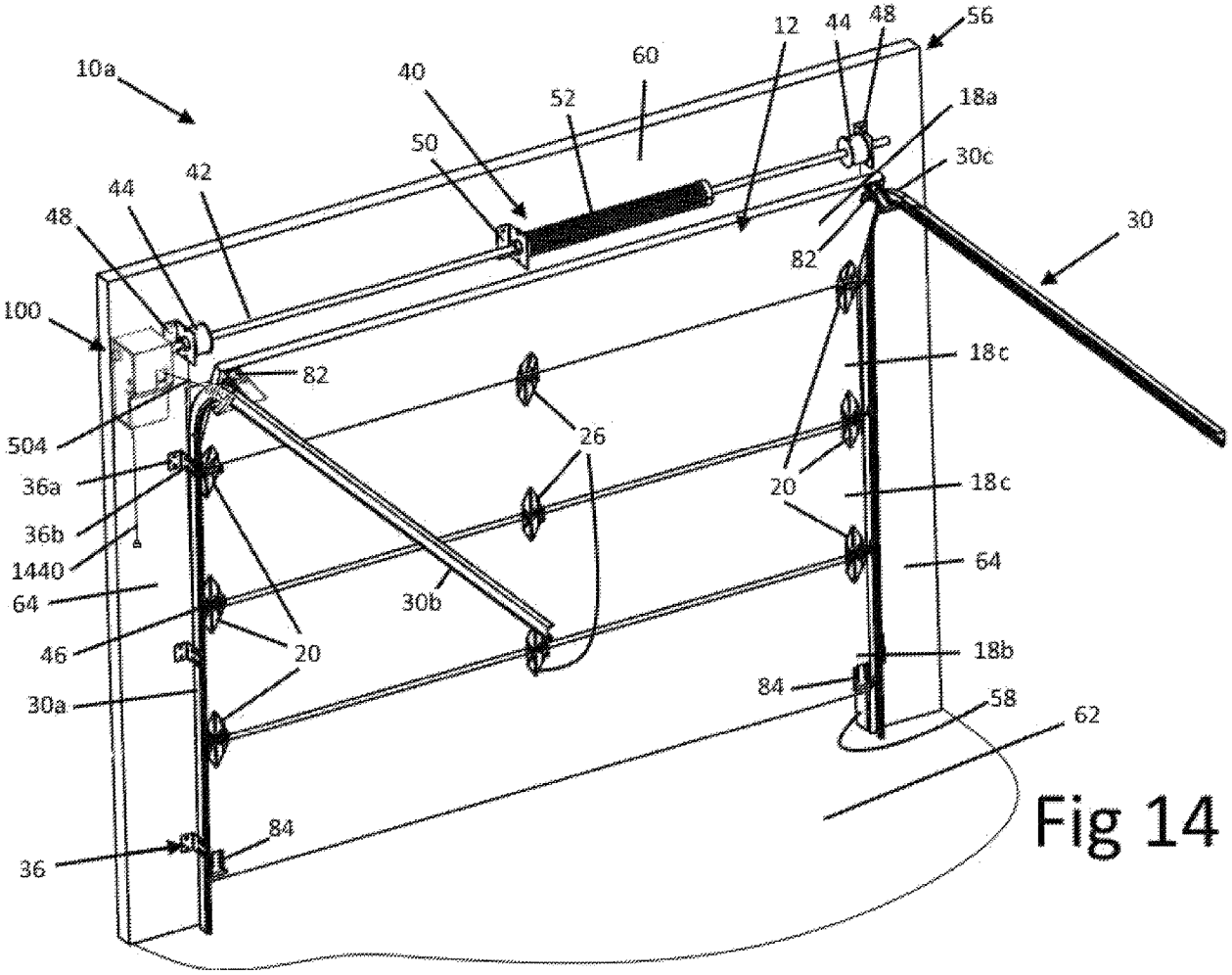
FIG. 14 is a perspective view of a door system with a standard lift sectional door and a second embodiment of a drive device of the present invention.

Mounted proximate to door shaft 42 and to the left hand side of sectional door 12 is motorized operator 1100 as seen in FIG. 14. Referring to FIG. 16*a* motorized operator 1100 is comprised of a frame 1110 to which is mounted a motor assembly 1150, a drive shaft assembly 1300, a disconnect assembly 1400, an operator cable drum shaft assembly 1500, a power supply 1224, a control circuit 1220, and tab bracket 1120 secured to frame 1110 with a nut 1130.

Figure 16:
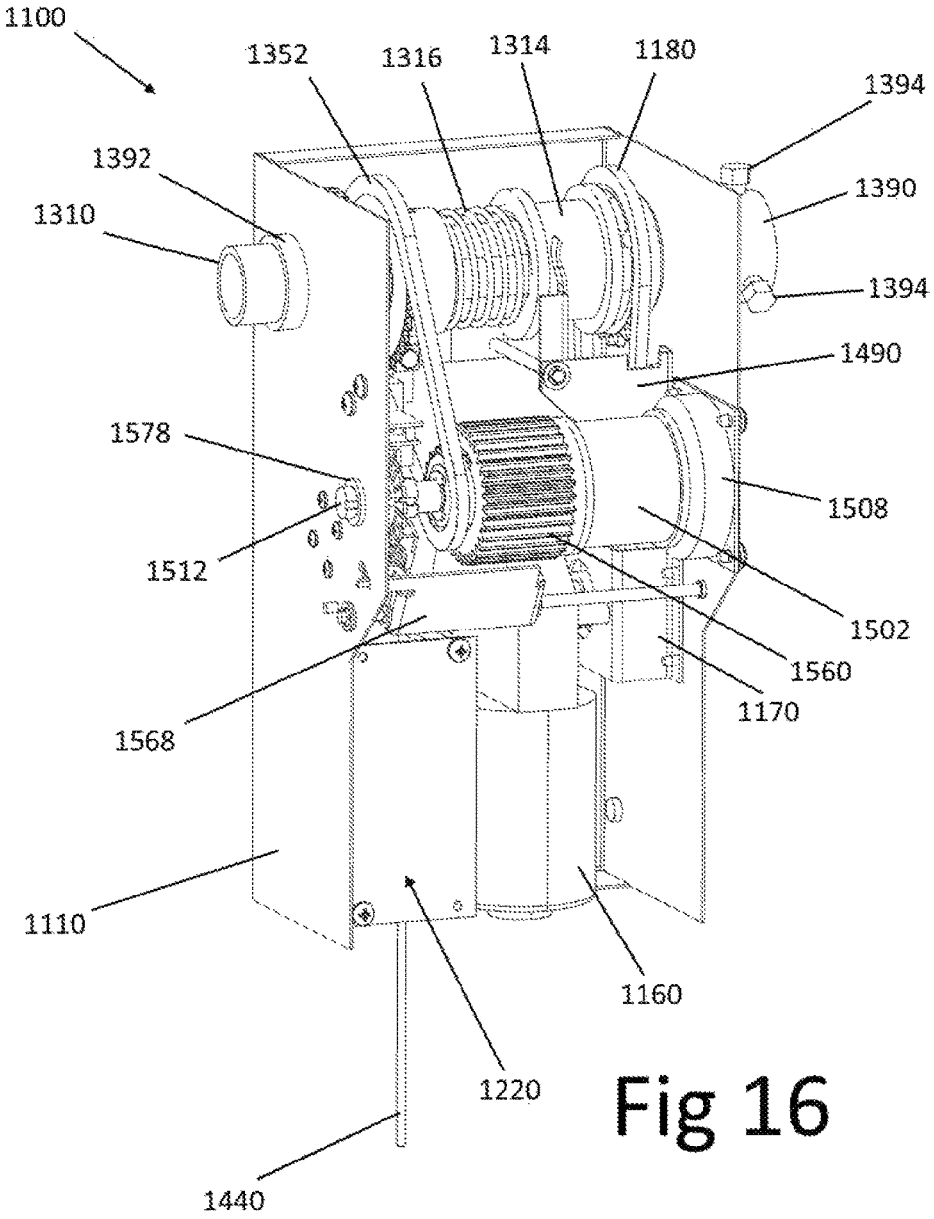
FIG. 16 is a perspective view of the internal components of a second embodiment of the drive device of the present invention with the outside cover removed.
Figure 16A:
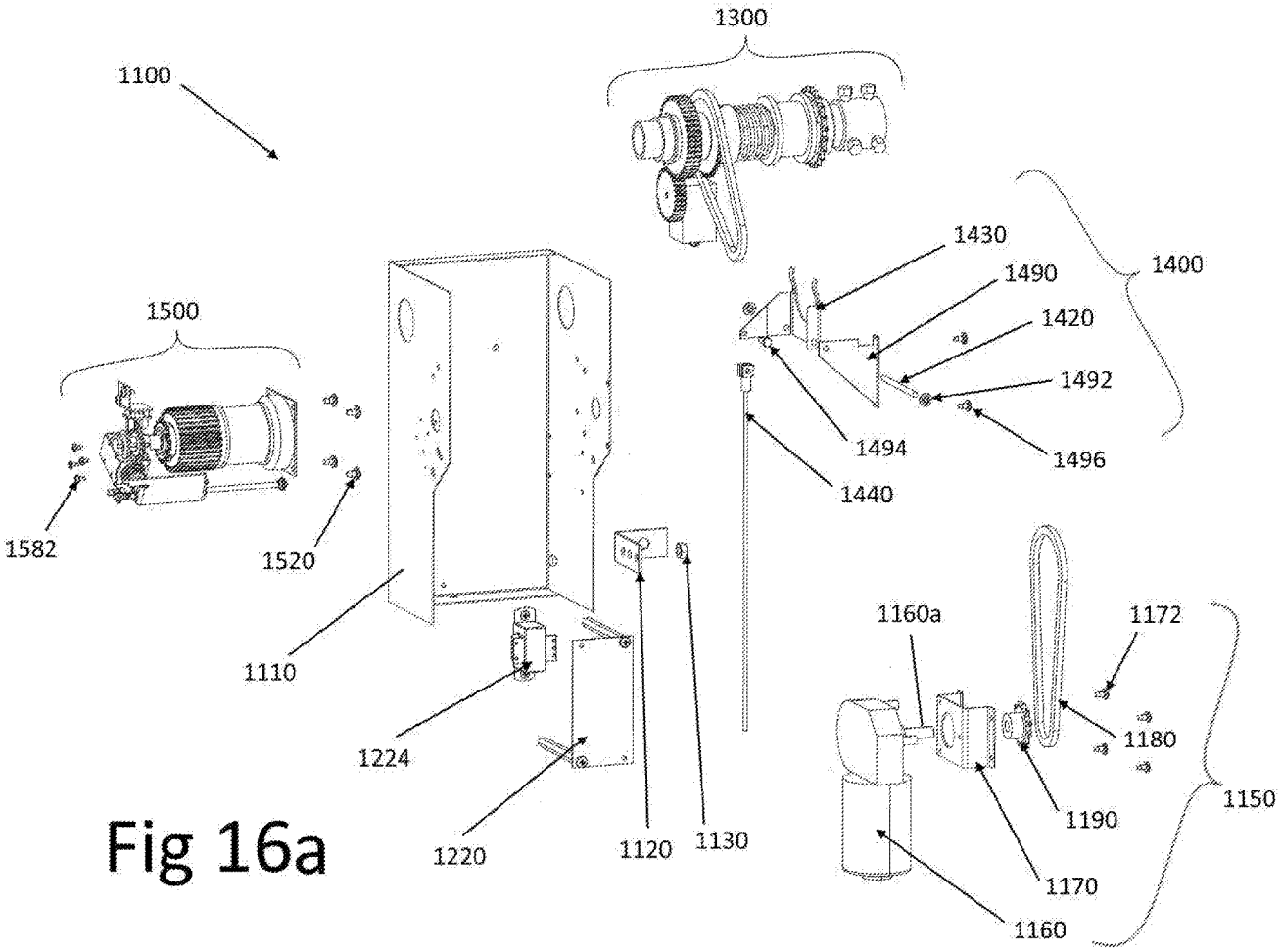
FIG. 16*a* is a perspective and exploded view of the internal components of a second embodiment of the drive device of the present invention with the outside cover removed.

Referring to FIGS. 16 and 16*a* motor assembly 1150 is comprised of a motor 1160 which is connected to a bracket 1170 which is attached to frame 1110 using a screw 1172 in multiple locations. A driving sprocket 1190 is rotatably coupled to motor shaft 1160*a* and turns a roller chain 1180.

Figure 17:
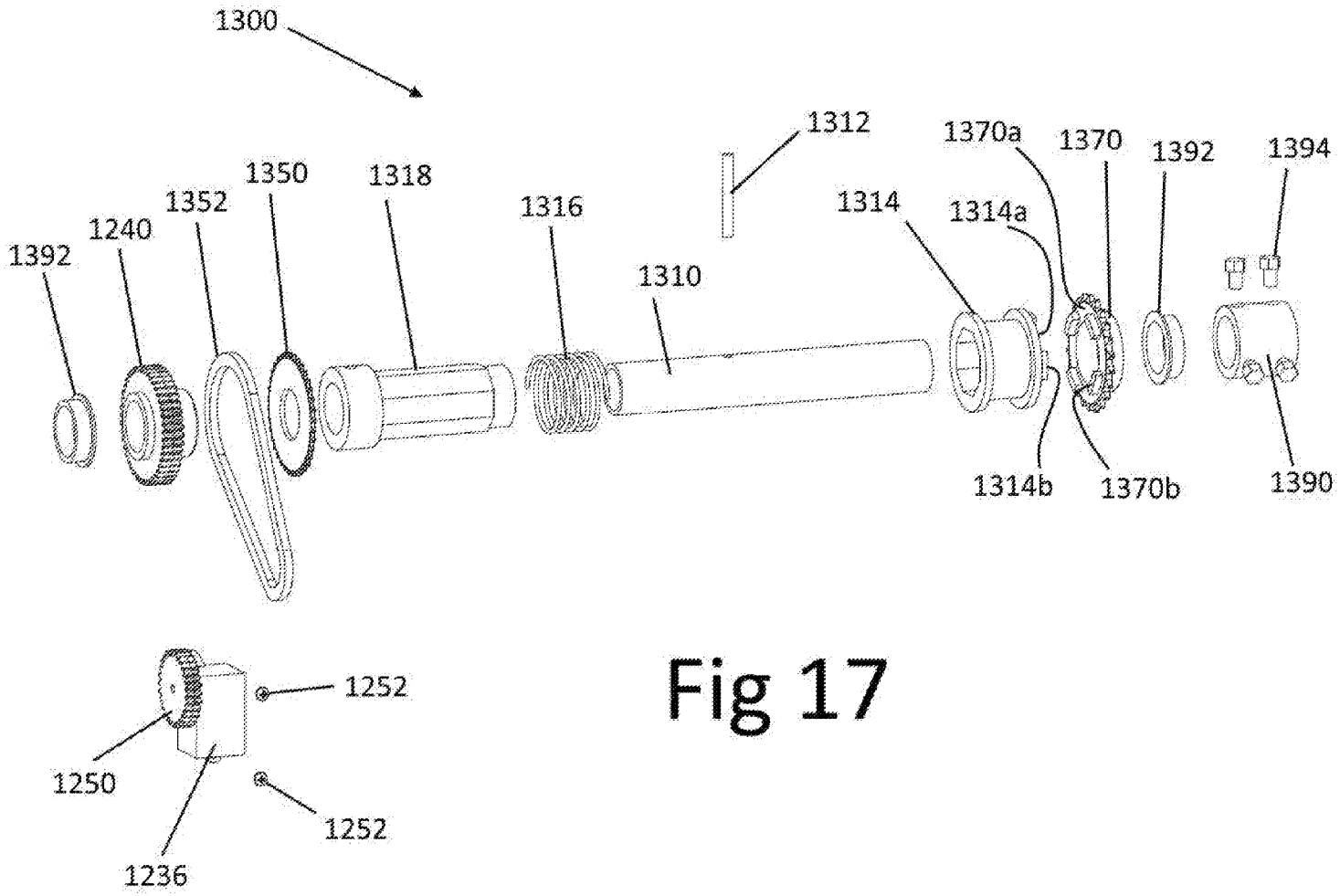
FIG. 17 is a perspective and exploded view of the internal components of the drive shaft assembly of a second embodiment of the drive device of the present invention.

Referring to FIGS. 16 and 17 drive shaft assembly 1300 is supported within frame 1110 by way of a bushing 1392 located at each end. A drive tube 1310 is supported through each bushing 1392 and extends outwards from each side of frame 1110. One end of a drive coupler 1390 is secured to one end of drive tube 1310 by way of a set screw 1394. The other end of drive coupler 1390 is rotatably coupled and axially affixed to door shaft 42 by way of at least one set screw 1394. A hex drive sleeve 1318 is mounted over drive tube 1310 and is rotatably and axially affixed to drive tube 1310 by way of a spring pin 1312. Hex drive sleeve 1318 has a cable drum drive sprocket 1350 affixed at one end with a roller chain 1352 driven by it, and has a slider 1314 rotatably coupled by the hex geometry of the shaft but remains axially translatable. A disconnect spring 1316 is also mounted over hex drive sleeve 1318 and is in contact with cable drum drive sprocket 1350 on one end and is compressed and contacts slider 1314 on the other end. Disconnect spring 1316 forces slider 1314 into contact with a driven sprocket 1370 which abuts bushing 1392 on one end and is mounted over a turned portion at the end of hex drive sleeve 1310. Driven sprocket 1370 has a sprocket face 1370*a* with a set of dentil teeth 1370*b* equally spaced out radially across it. The dentil teeth 1370*b* are interposed between a set of dentil teeth 1314*b* equally spaced out radially across a slider face 1314*a*. A drive gear 1240 is also rotatably coupled to drive tube 1310 and is captured between bushing 1392 and cable drum drive sprocket 1350. Drive gear 1240 rotates a driven sprocket 1250 which is attached to a first sensor or counterbalance shaft sensor 1236 which is attached to frame 1110 by way of a screw 1252. Motorized operator 1100 is connected to jamb 64 through a tab bracket 1120 which is bolted to a frame 1110.

Referring back to FIG. 16*a* disconnect assembly 1400 is comprised of a disconnect bracket 1490 bolted to frame 1110 by at least one screw 1496. A fork bracket 1430 supported by and pivotal around a pin 1420 that is inserted through disconnect bracket 1490 and frame 1110. Pin 1420 is retained axially by push nut 1492 on both ends. A disconnect cable 1440 is attached to one end of fork bracket 1430 using a clevis pin 1494. Disconnect cable 1440 exits motorized operator 1100 through the bottom of frame 1110 and is accessible for manual operation.

Referring to FIGS. 16*a* and 18 motorized operator 1100 is also comprised of operator cable drum shaft assembly 1500 which is supported between frame 1110 generally parallel to drive shaft assembly 1300. A drum shaft 1512 is supported at each end through a bushing 1578 in frame 1110 and is axially affixed by way of a set of retaining clips 1584 connected to drum shaft 1512 just inside each bushing 1578 near the ends of drum shaft 1512. An operator cable drum 1502 is mounted along and is rotatably coupled to drum shaft 1512 by way of a key 1562. A tensioning device or power spring 1506 is connected to drum shaft 1512 at its inner end and is attached to a spring cover 1508 at its outer end. Spring cover 1508 is mounted over drum shaft 1512 and is attached to frame 1110 by a screw 1520 in multiple locations. A driven sprocket 1518 is supported by drum shaft 1512 and rotatably coupled to drum shaft 1512 through a wrap spring 1556 that connects radially to a hub 1552 when turned in one direction. Hub 1552 is rotatably coupled to drum shaft 1512 by way of key 1562. A stop collar 1560 is positioned around wrap spring 1556 and is used to disengage wrap spring 1556 when rotated in the engaged direction. Referring to FIGS. 18 and 19*a* stop collar 1560 is comprised of a first pocket 1560*a* and receives a first tab 1556*a* from wrap spring 1556. As shown in FIG. 19*c* stop collar 1560 is also comprised of a second pocket 1560*b* for receipt of a second tab 1556*b* from wrap spring 1556 as shown in FIG. 18*c*. Referring to FIG. 19*b*, stop collar 1560 is positioned around wrap spring 1556 which is situated over driven sprocket 1518 on one end and over hub 1552 on the opposite end.

Referring to FIG. 18, a stop bracket 1568 is mounted over top of pin 1570 and is axially positioned by a push nut 1580 installed over each end of pin 1570 on the outside of frame 1110 up against bushings 1586. Stop bracket 1568 is positioned axially by push nut 1580 on its left and right side along shaft 1570. Stop bracket 1568 has a tab 1568*a* which protrudes through frame 1110 and is accessible for manual operation. A torsion spring 1576 is mounted over pin 1570 and is contained on one end by a shoulder bolt 1588 attached to frame 1110 and on the other end contacts and keeps stop bracket 1568 biased away from stop collar 1560.

Solenoid assembly 1563 is mounted to frame 1110 by way of a screw 1582 in several locations as shown in FIG. 16*a*. Referring to FIG. 18 solenoid assembly 1563 is comprised of a solenoid coil 1564, an armature 1566, and a compression spring 1574. Stop bracket 1568 is connected to armature 1566 by way of a clevis pin 1572.

Referring to FIG. 18, mounted along and rotatably coupled to drum shaft 1512 is an opto-wheel 1510. Opto-wheel 1510 has a series of gaps around its perimeter. A second sensor or operator cable drum sensor 1238 is mounted to frame 1110 by way of a pair of screws 1590 and is positioned over top of opto-wheel 1510 so as to sense rotations of drum shaft 1512 and thereby rotation of operator cable drum 1502.

Figure 15:
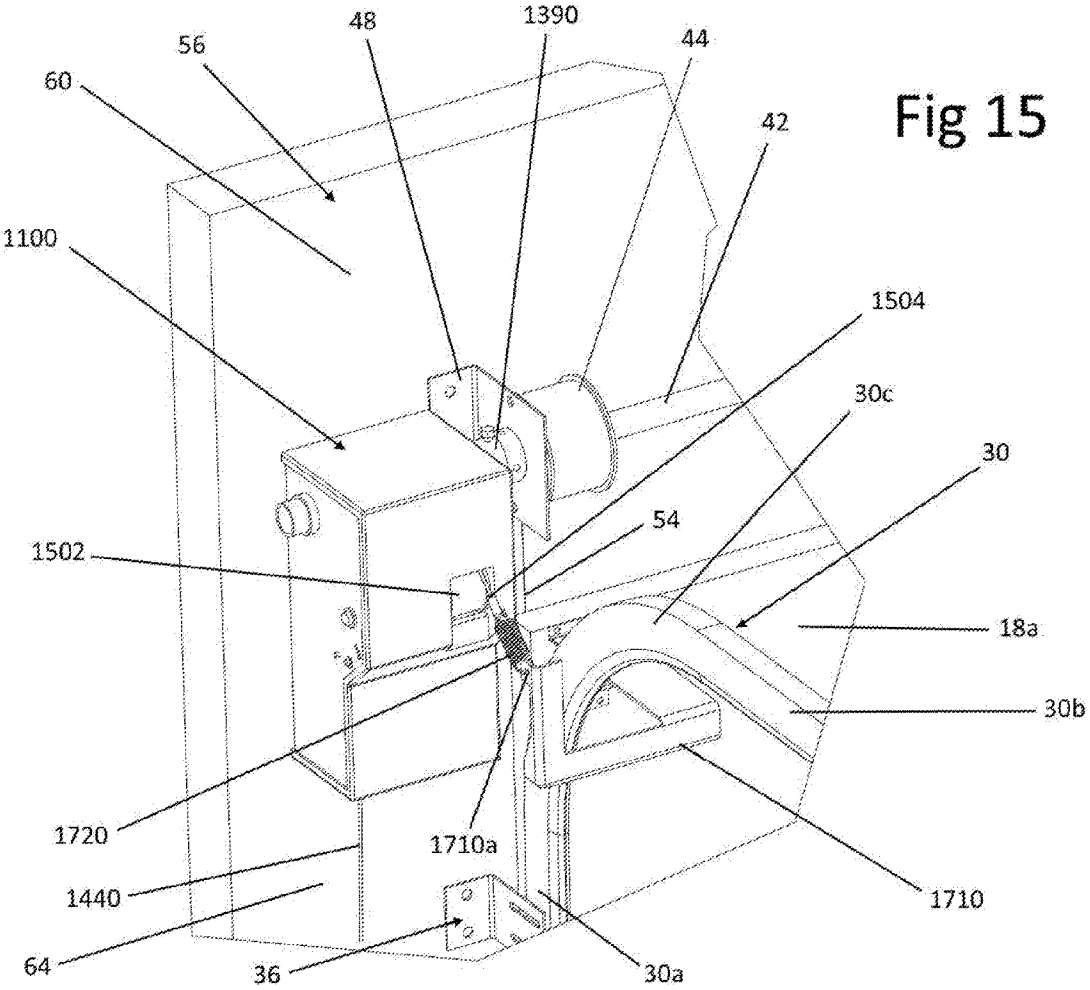
FIG. 15 is a close-up perspective view of a door system with a standard lift sectional door and a second embodiment of a drive device of the present invention.

Referring to FIG. 15, one end of upper cable 1504 is attached to and spooled around operator cable drum 1502 and the opposite end of upper cable 1504 is attached to sectional door 12 by way of a tensile member 1720 which is attached to an upper cable attachment point 1710*a* which is part of an upper cable bracket 1710 which is mounted to upper door section 18*a*. Upper cable bracket 1710 extends outward perpendicular from upper door section 18*a* and then extends around to the outside of track assembly 30 along a plane generally parallel to upper door section 18*a* thereby locating upper cable attachment point 1710*a* outside the path of sectional door 12 during movement between the open and closed position. Upper cable attachment point 1710*a* allows for tensile member 1720 and thereby upper cable 1504 to be attached to sectional door 12 outside the path of travel of sectional door 12 between the open and closed position along the path of track assembly 30.

Figure 26:
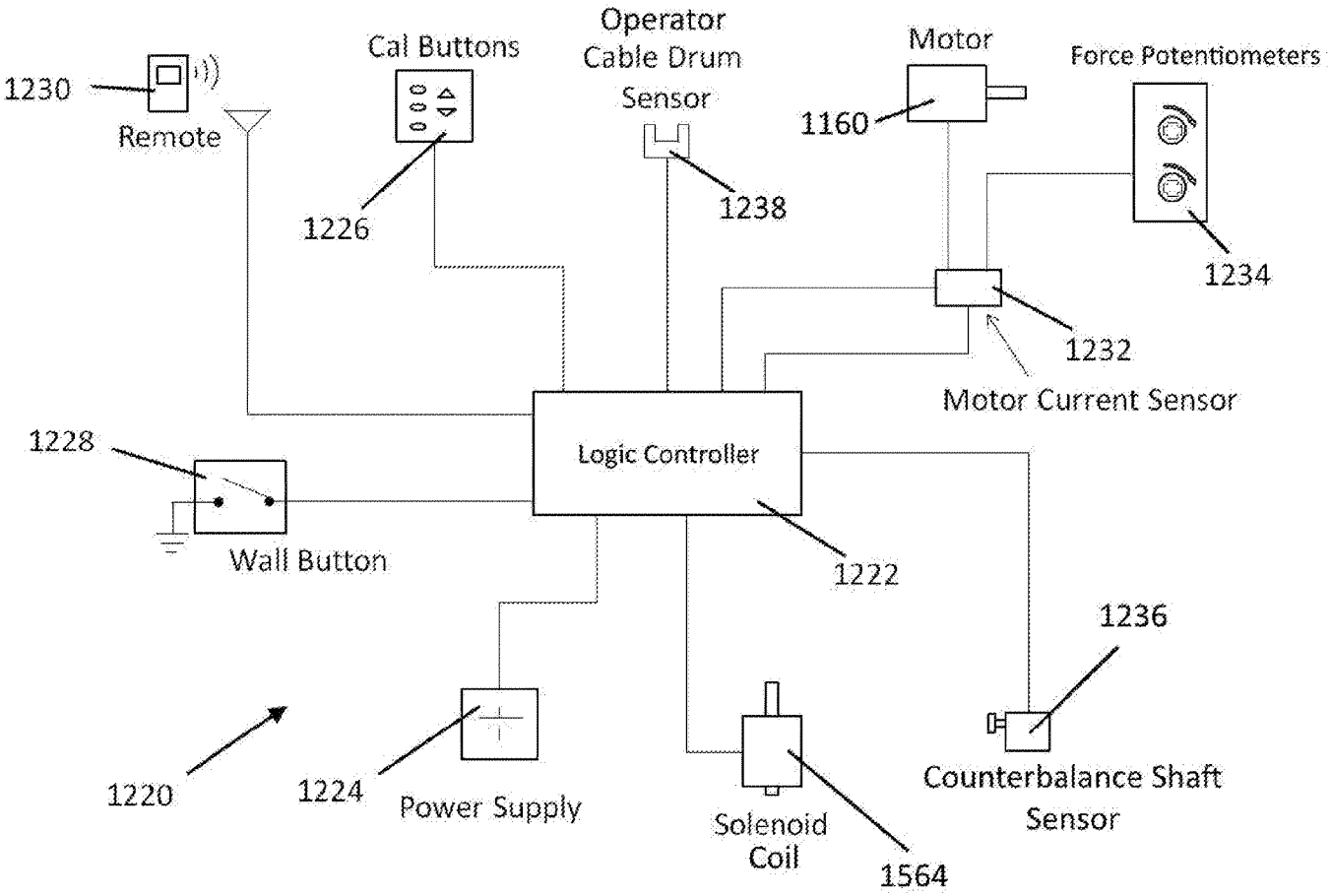
FIG. 26 is a schematic view of the control circuit of a second embodiment of the drive device of the present invention.

In FIG. 26 a schematic view of a control circuit 1220 is shown. This is a high level overview and therefore does not show drive circuits, conditioning circuits, shielding, etc. that the completed motorized operator 1100 control circuit 1220 includes which would be easily understood by those skilled in the art. Motorized operator 1100 is comprised of a logic controller 1222 which monitors inputs and utilizes programmed logic to control outputs. Logic controller 1222 is connected to and is in control of motor 1160. A power supply 1224 provides power to the logic controller 1222 and all of the control circuit 1220. A counterbalance shaft sensor 1236 is connected to drive tube 1310 which remains in rotatable connection to door shaft 42. An absolute type of sensor may be utilized for counterbalance shaft sensor 1236 therefore sectional door 12 could be moved manually without power applied to control circuit 1220. Upon restoration of power, logic controller 1222 is able to determine the position of the door shaft 42 and thereby the position of sectional door 12. Operator cable drum sensor 1238 is connected to logic controller 1222 and generates pulses as opto-wheel 1510 connected to drum shaft 1512 rotates. Logic controller 1222 monitors the pulses received from operator cable drum sensor 1238. By utilizing a motor current sensor 1232 to sense the amount of current being pulled by motor 1160 the amount of relative force required to move sectional door 12 can be determined. The amount of current pulled by motor 1160, is directly related to the amount of torque motor 1160 is applying to move sectional door 12. While sectional door 12 is closing, logic controller 1222 monitors the drive current from a motor current sensor 1232. If the monitored drive current exceeds a pre-determined amount then logic controller 1222 could initiate a reversal. The pre-determined amount may be field adjustable by using a force potentiometer 1234 or some other method known by those skilled in the art. Control circuit 1220 is also comprised of a wall button 1228 and a remote 1230 either of which can be used to initiate the opening or closing of sectional door 12 via motorized operator 1100. Control circuit 1220 is further comprised of a calibration interface or cal buttons 1226 for adjusting the control settings during installation or service.

Having described the general structure of a second embodiment of the jackshaft opener of the present invention, its function will now be described in general terms.

Figure 23:
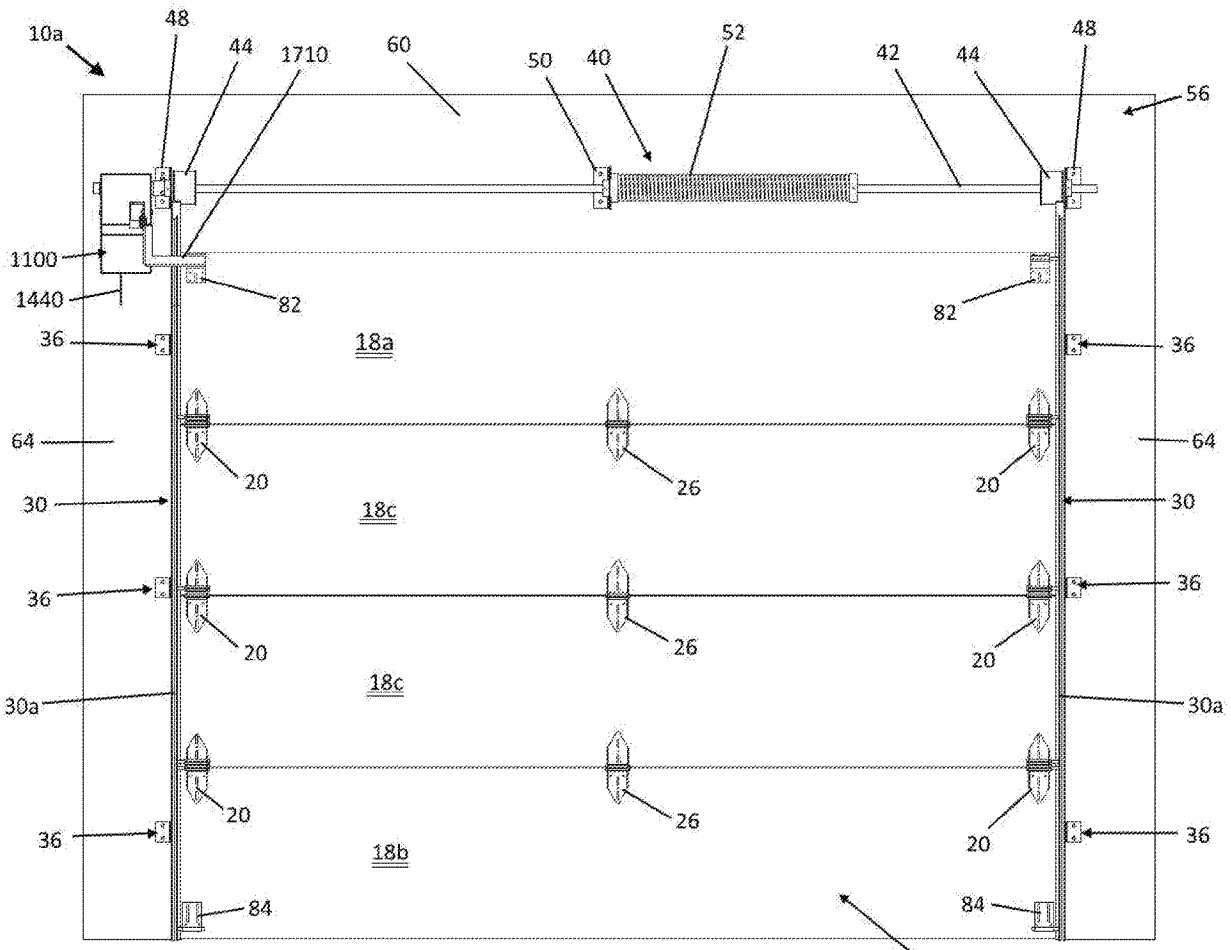
FIG. 23 is a rear elevational view of a door system with a standard lift sectional door in the closed position and a second embodiment of a drive device of the present invention.

Referring to FIG. 23, motorized operator 1100 is mounted to the counterbalance assembly 40 from either the left or right (not shown) side of the sectional door 12. By placing drive coupler 1390 and drive tube 1310 over the end of door shaft 42 as shown in FIG. 14 drive coupler 1390 can be rotatably coupled to door shaft 42 by using set screws 1394 shown in FIG. 17. Motorized operator 1100 is further mounted to door frame 56 by attaching tab bracket 1120 shown in FIG. 16*a* to jamb 64 shown in FIG. 15. As drive tube 1310 and drive coupler 1390 rotate door shaft 42 during the opening and closing of sectional door 12, the tab bracket 1120 attached to jamb 64 prevents the motorized operator 1100 and operator frame 1110 from rotating around door shaft 42.

Referring to FIG. 18, stop bracket 1568 is manually moved by tab 1568*a* forcing the top edge of stop bracket 1568 to contact stop collar 1560 thereby preventing stop collar 1560 from rotating. Referring to FIG. 19*c* second tab 1556*b* of wrap spring 1556 has a second tab face 1556*d* which then contacts a second stop face 1560*d* of stop collar 1560 which in turn causes wrap spring 1556 to stop rotating and unwrap from hub 1552 thereby disconnecting operator cable drum 1502 from motor 1160. Referring to FIG. 15 again, upper cable 1504 can now be pulled to manually unspool it from operator cable drum 1502 while still being tensioned by power spring 1506 shown in FIG. 18. Upper cable 1504 can be pulled out far enough to allow tensile member 1720, which is already attached to upper cable 1504, to be connected to upper cable bracket 1710 at upper cable attachment point 1710*a*. Once tensile member 1720 is connected to upper cable bracket 1710, tab 1568 can be manually released which allows torsion spring 1576 to force stop bracket 1568 away from, and out of connection with, stop collar 1560.

Figure 20:
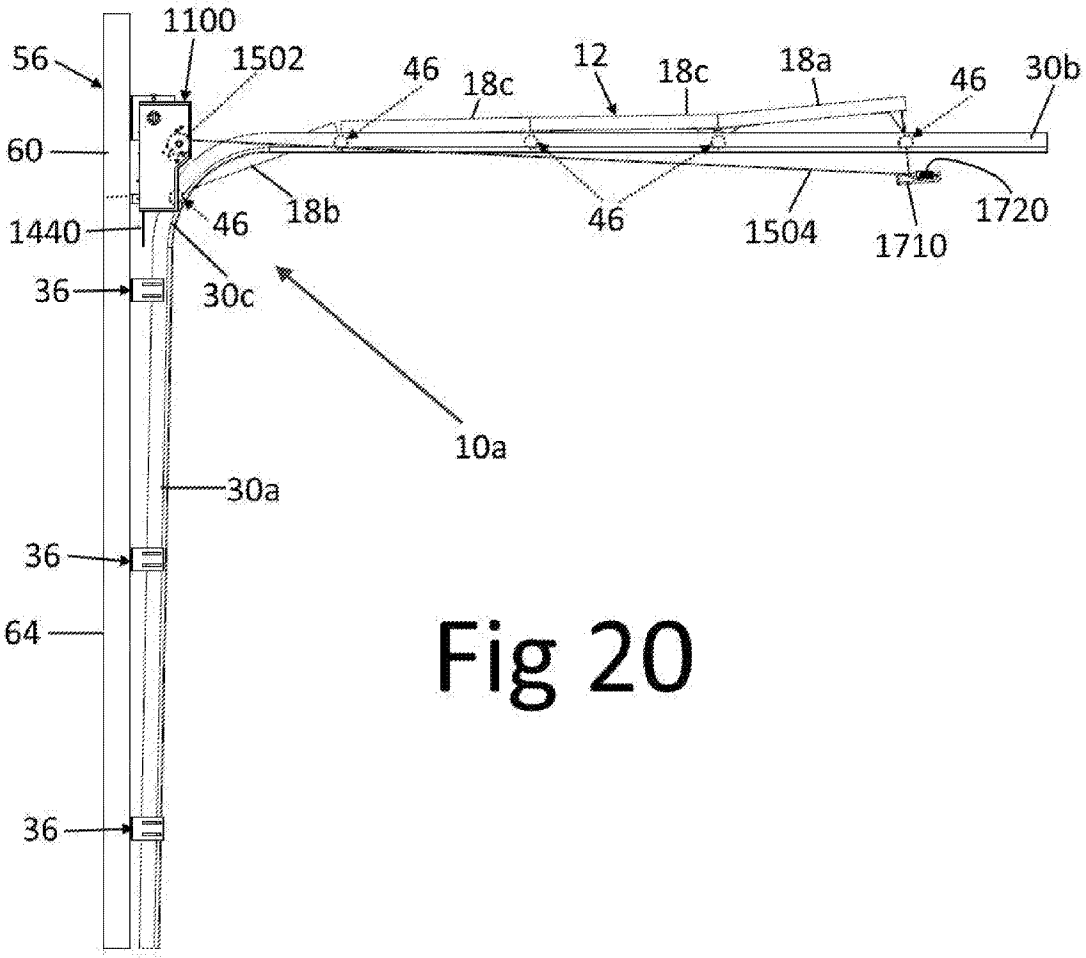
FIG. 20 is a left elevational view of a door system with a standard lift sectional door in the open position and a second embodiment of the drive device of the present invention.
Figure 21:
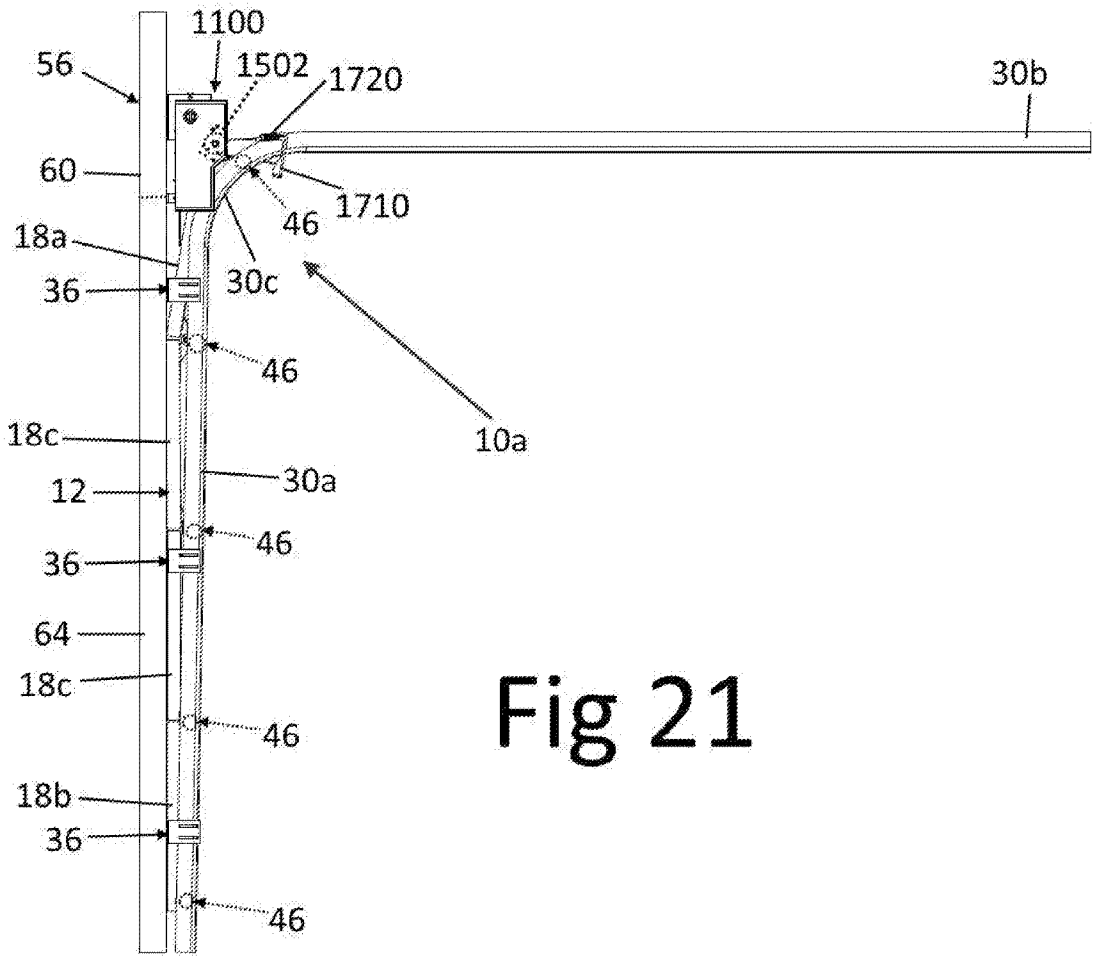
FIG. 21 is a left elevational view of a door system with a standard lift sectional door opened to a position just above the closed position and a second embodiment of the drive device of the present invention.
Figure 22:
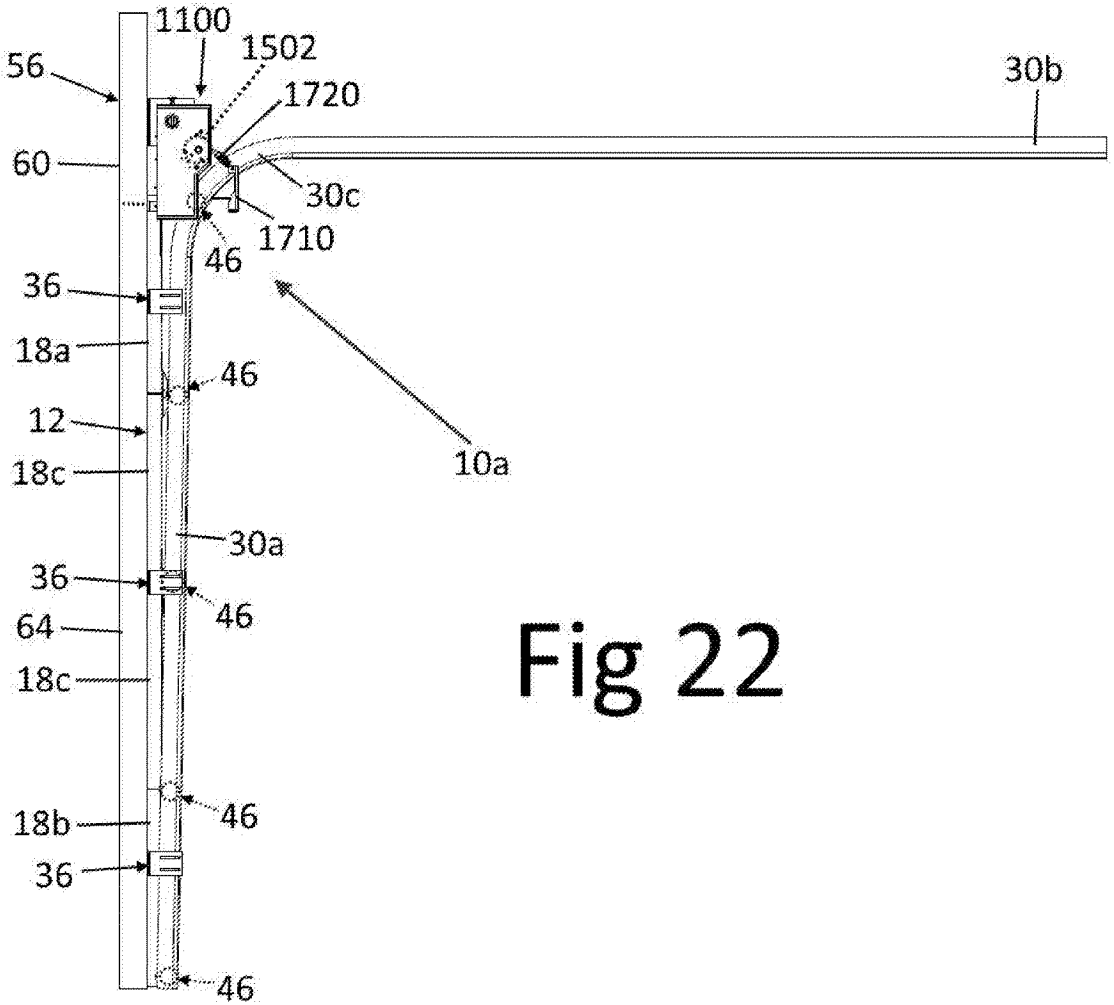
FIG. 22 is a left elevational view of a door system with a standard lift sectional door in the closed position and a second embodiment of a drive device of the present invention.
Figure 24:
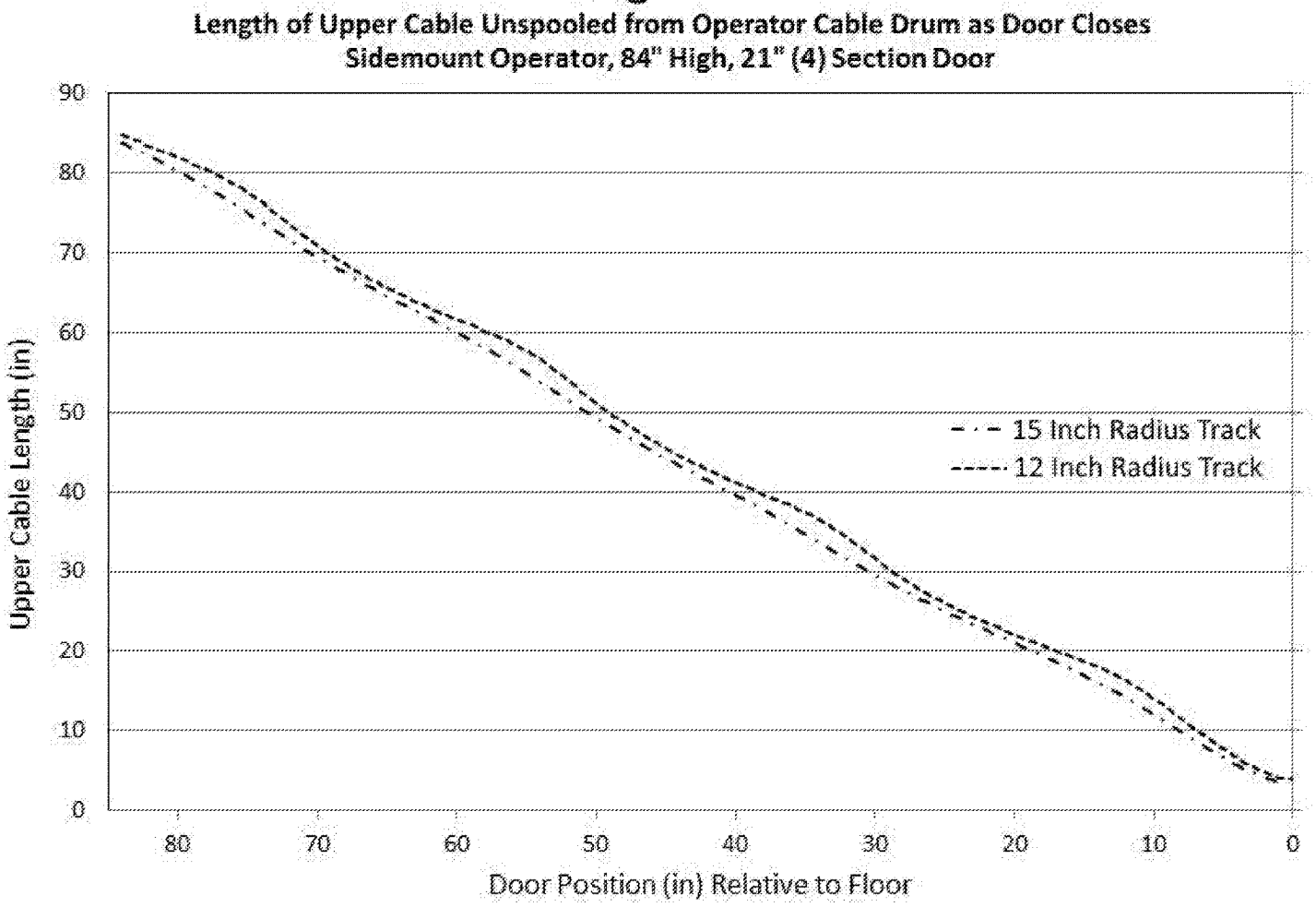
FIG. 24 is a graphical representation of the change in the length of upper cable unspooled from operator cable drum of a second embodiment of the drive device of the present invention over the closing position of a standard lift sectional door.
Figure 25:
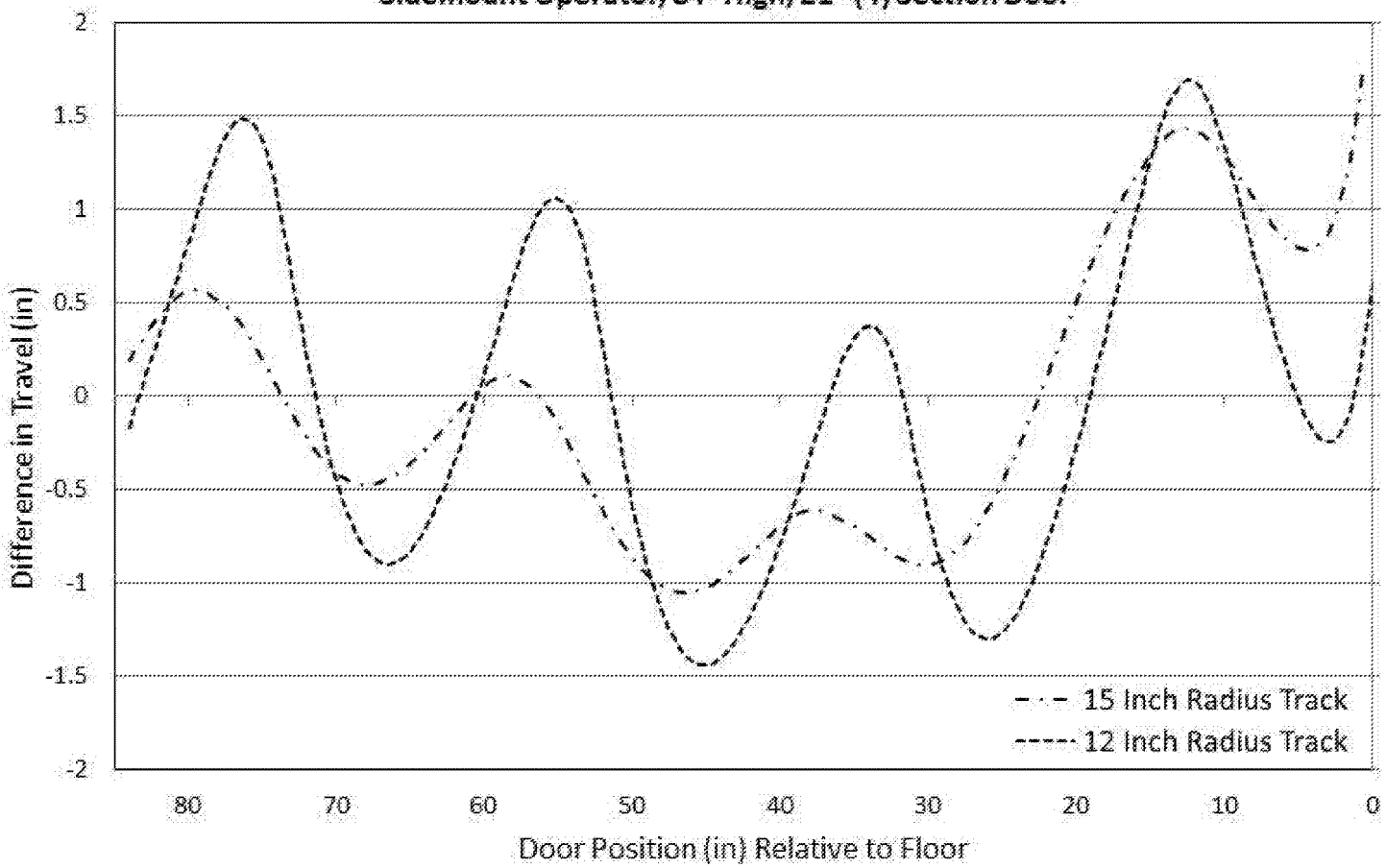
FIG. 25 is a graphical representation of the difference in the travel of the upper cable of a second embodiment of the drive device of the present invention as it is spooled versus the travel of the lower cable of a door system as it is unspooled over the closing of a standard lift sectional door from the open to closed position.

Operator cable drum 1502 on motorized operator 1100 sits below the door shaft 42 vertically, relative to the floor. The relative position of operator cable drum 1502 below door shaft 42 and the upper connection point for attaching tensile member 1720 to cable bracket 1710 allows for the unspooled length of upper cable 1504 from operator cable drum 1502 to be at its shortest length when sectional door 12 is in the closed position as shown in FIG. 22. As sectional door 12 is first opened operator cable drum 1502 pays out some upper cable 1504 as shown in FIG. 21. When sectional door 12 is in the open position almost all of the upper cable 1504 has been unspooled and paid out from operator cable drum 1502 as shown in FIG. 20. As shown in FIG. 24, the amount of upper cable 1504 taken up and spooled onto operator cable drum 1502 during the closing of sectional door 12, relative to the floor, is generally linear over its travel from the open to the closed position. Any slight difference in the rate of upper cable 1504 paid out compared to the rate of lift cable 54 attached to section 18*b* of sectional door 12 and counterbalance cable drums 44 being taken up or paid out can be taken up in tensile member 1720. FIG. 25 shows the total difference in the amount of upper cable 1504 taken up versus lift cable 54 paid out during the closing of sectional door 12 from the open position to the floor. When the amount of upper cable 1504 taken up is greater than the amount of lift cable 54 paid out tensile member 1720 is stretched to accommodate the difference. When the amount of upper cable 1504 taken up is less than the amount of lift cable 54 paid out then wrap spring 1556 acts as an overrunning clutch allowing power spring 1506 to take up additional upper cable 1504 accommodating the difference while continuing to keep upper cable 1504 wrapped on operator cable drum 1502 with tension. This may eliminate the need to disengage wrap spring 1556 and thereby operator cable drum 1502 from being driven by motor 1160 during the opening or closing of sectional door 12.

Once operator 1110 is mounted to the counterbalance assembly 40 and to door frame 56 the opening and closing limits can be set in logic controller 1222. When control circuit 1220 is first powered up there are no limits set in the logic controller 1222. With sectional door 12 in the closed position a cal button 1226 is used to prompt logic controller 1222 to record the current position of the counterbalance shaft sensor 1236 as the down limit. Sectional door 12 is then moved to its desired open position and logic controller 1222 is prompted to record the new position as the up limit using cal button 1226.

Normal operation of motorized operator 1100 is initiated through either a wall button 1228 or a remote 1230 input to logic controller 1222. If sectional door 12 is in, or near, the closed position and logic controller 1222 receives an opening input request from either wall button 1228 or remote 1230 logic controller 1222 will energize motor 1160 in the open direction which turns driving sprocket 1190 and thereby transfers power through roller chain 1180 to driven sprocket 1370 causing driven sprocket 1370 to rotate. As driven sprocket 1370 is rotated dentil teeth 1370*b* contact slider dentil teeth 1314*b* on slider 1314 causing it to rotate. Slider 1314 has a hex bore through its center that turns hex drive sleeve 1318 which through a spring pin 1312 connection thereby rotates drive tube 1310, drive coupler 1390, and door shaft 42 in the open direction which transmits power to counterbalance cable drums 44 to take up lift cables 54 thereby lifting sectional door 12 to the open position.

During the opening of sectional door 12 power spring 1506 keeps upper cable 1504 tensioned and spooled on operator cable drum 1502 by overrunning wrap spring 1556 in one direction. Hex drive sleeve 1318 rotates driving sprocket 1350 which moves roller chain 1352 which is connected to and thereby rotates driven sprocket 1518 on operator cable drum shaft assembly 1500. In this embodiment, driving sprocket 1350 is approximately twice as large as the driven sprocket 1518 which causes the drum shaft 1512, and thereby operator cable drum 1502, to rotate approximately twice as fast as door shaft 42. Operator cable drum 1502 has a functional diameter for spooling upper cable 1504 that is approximately half the functional diameter of counterbalance cable drums 44 which spools lift cables 54. This combined with approximately twice the rotational speed, results in operator cable drum 1502 paying out in the open direction, and taking up in the closed direction, upper cable 1504 at nearly the same rate as counterbalance cable drums 44 take up in the open direction, or pay out in the close direction, lift cables 54. This allows operator cable drum 1502 to be of a smaller overall diameter than counterbalance cable drums 44 so as to make a smaller envelope when included as part of motorized operator 1100.

As driven sprocket 1518 is rotated in the open direction it turns wrap spring 1556 in a direction which unwraps the wrap spring 1556 from connection to the hub of driven sprocket 1518. As sectional door 12 is being opened, upper cable 1504 is paid out from operator cable drum 1502 while still being tensioned by power spring 1506. At a predetermined time or position, as determined from counterbalance shaft sensor 1236, logic controller 1222 de-energizes motor 1160 to stop sectional door 12 at the open position.

If sectional door 12 is in, or near, the open position and logic controller 1222 receives a closing input request from either wall button 1228 or remote 1230, logic controller 1222 will energize motor 1160 in the close direction which turns driving sprocket 1190 and thereby transfers power through roller chain 1180 connected to driven sprocket 1370 causing driven sprocket 1370 to rotate. As driven sprocket 1370 is rotated dentil teeth 1370*b* contact slider dentil teeth 1314*b* on slider 1314 causing it to rotate in the closed direction. Slider 1314 has a hex bore through its center that turns hex drive sleeve 1318 which through a spring pin 1312 connection thereby rotates drive tube 1310, drive coupler 1390, and door shaft 42 in the close direction which transmits power to counterbalance cable drums 44 to pay out lift cables 54 thereby lowering sectional door 12 to the closed position.

During the closing of sectional door 12, hex drive sleeve 1318 rotates driving sprocket 1350 which moves roller chain 1352 which is connected to, and thereby rotates, driven sprocket 1518 on operator cable drum shaft assembly 1500. As driven sprocket 1518 is rotated in the close direction it causes wrap spring 1556 to wrap down on, and rotatably connect to, the hub of driven sprocket 1518. Wrap spring 1556 which is now rotatably connected to driven sprocket 1518 also wraps tight around and rotates hub 1552 which rotates drum shaft 1512 by way of key 1562. Drum shaft 1512 rotates operator cable drum 1502 also by way of key 1562. As operator cable drum 1502 rotates in the close direction it takes up and spools upper cable 1504 thereby applying a force in the closing direction to upper door section 18*a* of sectional door 12 by way of tensile member 1720 connected to upper cable bracket 1710 mounted on upper door section 18*a*.

Sectional door 12 continues to close until logic controller 1222 determines through counterbalance shaft sensor 1236 that the down limit has been reached at which time logic controller 1222 de-energizes motor 1160 thereby stopping sectional door 12 from further closing.

Solenoid assembly 1563 may be used to disengage wrap spring 1556 during motorized operation of sectional door 12. While sectional door 12 is closing from at, or near, the open position after a pre-determined amount of time, or movement in the closed direction, solenoid coil 1564 may be energized which pulls in armature 1566 and thereby stop bracket 1568 and forces the top edge of stop bracket 1568 to contact stop collar 1560 thereby preventing stop collar 1560 from rotating. Referring to FIG. 19*a* first tab 1556*a* of wrap spring 1556 has a first tab face 1556*c* which then contacts a first stop face 1560*c* of stop collar 1560 which causes wrap spring 1556 to stop rotating and unwrap from driven sprocket 1518 thereby rotatably disconnecting operator cable drum 1502 from motor 1160. Upper cable 1504 is now taken up on operator cable drum 1502 only by the tension applied by power spring 1506. Once sectional door 12 reaches the closed position, solenoid coil 1564 can be de-energized thereby allowing the stop bracket 1568 to move out of contact with stop collar 1560.

During the closing of sectional door 12 from the open position, logic controller 1222 compares pulses received from operator cable drum sensor 1238 to rotations of door shaft 42 through counterbalance shaft sensor 1236. If logic controller 1222 determines the pulses from operator cable drum sensor 1238 have slowed or stopped, compared to the rotations of door shaft 42 being reported by counterbalance shaft sensor 1236, then the logic controller 1222 may de-energize motor 1160 thereby stopping sectional door 12 from closing any further, and possibly reverse directional movement of sectional door 12 to the open limit depending on where sectional door 12 stopped in relation to the floor.

Someone trying to manually force sectional door 12 open will cause upper door section 18*a* to apply a force on upper cable 1504 which thereby attempts to rotate operator cable drum 1502. When motor 1160 is stopped it is non-backdrivable and thereby prevents operator cable drum 1502, and upper cable 1504, from moving which secures sectional door 12 from being manually forced open. If someone needs to open sectional door 12 manually, a disconnect assembly 1400 is provided. A disconnect cable 1440, accessible from the secured side of the door, can be pulled manually which causes fork bracket 1430 to rotate about pin 1420 and then contact, and move, slider 1314 along hex drive sleeve 1318 to compress disconnect spring 1316. Slider 1314 moves out of rotatable connection with driven sprocket 1370 when slider dentil teeth 1314*b* are no longer contacting dentil teeth 1370*b* of driven sprocket 1370. Sectional door 12 can then be manually opened or closed as needed. Once sectional door 12 has been manually positioned where desired, the disconnect cable 1440 can be released thereby allowing disconnect spring 1316 to force slider 1314 back into rotatable connection with driven sprocket 1370.

Other variations are also within the spirit of the present invention. Thus, while the invention is susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Several embodiments of this invention are described herein. Variations of those embodiments may become apparent to those of ordinary skill in the art upon reading the foregoing description. The inventor expects skilled artisans to employ such variations as appropriate, and the inventor intends for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A drive system for moving a barrier between an open position and a closed position comprising:

a counterbalance assembly comprising: a counterbalance shaft; and at least one counterbalance flexible linkage storage unit wherein said counterbalance shaft is drivingly connected to said counterbalance flexible linkage storage unit;

a first flexible linkage wherein one end is connected to a bottom section of said barrier and an opposite end is connected to and spooled around said counterbalance flexible linkage storage unit;

an operator;

wherein said operator comprises: a motor; an operator flexible linkage storage unit; a second flexible linkage; a clutch; a tensioning device; and a logic controller;

wherein said motor is drivingly connected to said counterbalance shaft;

wherein said clutch, when engaged, drivingly connects said motor to said operator flexible linkage storage unit;

wherein said clutch, when disengaged, allows said operator flexible linkage storage unit to rotate independently of said motor;

wherein one end of said second flexible linkage is connected to a top section of said barrier and an opposite end is connected to and spooled around said operator flexible linkage storage unit;

wherein said motor rotates in a first direction thereby rotating said counterbalance flexible linkage storage unit so as to pay out said first flexible linkage thereby lowering said barrier from said open to said closed position;

wherein said motor rotates in a second direction thereby rotating said counterbalance flexible linkage storage unit to take up and spool said first flexible linkage thereby raising said barrier from said closed to said open position;

wherein said clutch is engaged at or near said barrier being at said open position and while said motor lowers said barrier said operator flexible linkage storage unit takes up and spools said second flexible linkage thereby pulling said barrier toward said closed position;

wherein while said barrier is being lowered toward said closed position said clutch is disengaged prior to said barrier reaching said closed position thereby allowing said second flexible linkage to be payed out instead of taken up as said top section of said barrier transitions from a mostly horizontal to a mostly vertical orientation; and wherein while said clutch is disengaged said operator flexible linkage storage unit is biased by said tensioning device to rotate multiple revolutions to take up and spool said second flexible linkage onto said operator flexible linkage storage unit.

2. The drive system of claim 1 wherein said logic controller engages said clutch when said operator closes said barrier from at or near said open position and further wherein said logic controller disengages said clutch prior to said barrier reaching said closed position.

3. The drive system of claim 1 wherein said tensioning device is a power spring.

4. The drive system of claim 1 wherein said clutch is a wrap spring clutch.

5. A drive system for moving a barrier between an open position and a closed position comprising:

a counterbalance assembly comprising: a counterbalance shaft; and at least one counterbalance flexible linkage storage unit wherein said counterbalance shaft is drivingly connected to said counterbalance flexible linkage storage unit;

a first flexible linkage wherein one end is attached to said barrier, and further wherein the opposite end of said first flexible linkage is attached to and spooled around said counterbalance flexible linkage storage unit;

an operator;

wherein said operator comprises: a motor; an operator flexible linkage storage unit; a second flexible linkage; a tensioning device; a first sensor for monitoring rotation of said counterbalance shaft; a second sensor for monitoring rotation of said operator flexible linkage storage unit; and, a logic controller;

wherein said motor is drivingly connected to said counterbalance shaft;

wherein one end of said second flexible linkage is attached to said barrier and the opposite end of said second flexible linkage is attached to and spooled around said operator flexible linkage storage unit;

wherein said operator flexible linkage storage unit is not drivingly connected to said motor and further wherein said tensioning device biases said operator flexible linkage storage unit to rotate multiple revolutions to take up and spool said second flexible linkage onto said operator flexible linkage storage unit;

wherein said motor rotates in a first direction thereby rotating said counterbalance flexible linkage storage unit so as to pay out said first flexible linkage thereby lowering said barrier from said open to said closed position;

wherein said motor rotates in a second direction thereby rotating said counterbalance flexible linkage storage unit to take up and spool said first flexible linkage thereby raising said barrier from said closed to said open position; and wherein in the event said barrier does not move while said first flexible linkage is payed out while said motor rotates in said first direction, said first sensor will sense rotation of said counterbalance shaft while said second sensor will no longer sense rotation of said operator flexible linkage storage unit.

6. The drive system of claim 5 wherein said logic controller monitors output of said first sensor and from said second sensor and further wherein said logic controller stops said operator from closing said barrier upon determining said second sensor is no longer sensing rotation of said operator flexible linkage storage unit while said first sensor continues to sense rotation of said counterbalance shaft.

7. A drive system for moving a barrier between an open position and a closed position comprising:

a counterbalance assembly comprising: a counterbalance shaft; and at least one counterbalance flexible linkage storage unit wherein said counterbalance shaft is drivingly connected to said counterbalance flexible linkage storage unit;

a first flexible linkage;

an operator;

wherein said operator comprises: a motor; an operator flexible linkage storage unit; a second flexible linkage; and a logic controller;

wherein one end of said first flexible linkage is attached to a bottom section of said barrier and the opposite end of said first flexible linkage is attached to and spooled around said counterbalance flexible linkage storage unit;

wherein one end of said second flexible linkage is attached to a top section of said barrier and the opposite end of said second flexible linkage is attached to and spooled around said operator flexible linkage storage unit;

wherein said motor is drivingly connected to said counterbalance shaft;

wherein said motor rotates in a first direction thereby rotating said counterbalance flexible linkage storage unit so as to pay out said first flexible linkage thereby lowering said barrier from said open to said closed position;

wherein said motor is drivingly connected to said operator flexible linkage storage unit for at least a portion of travel of said barrier from said open to said closed position thereby applying a force along said second flexible linkage pulling said barrier toward said closed position;

wherein said motor rotates in a second direction thereby rotating said counterbalance flexible linkage storage unit to take up and spool said first flexible linkage thereby raising said barrier from said closed to said open position; and wherein said counterbalance flexible linkage storage unit and said operator flexible linkage storage unit rotate about two separate axes that are spaced apart and generally parallel relative to each other.

8. The drive system of claim 7 wherein the said operator flexible storage unit has a smaller functional diameter than that of said counterbalance flexible linkage storage unit; and wherein the said operator flexible storage unit rotates faster than said counterbalance flexible linkage storage unit thereby allowing said second flexible linkage to be payed out and taken up at, or nearly at, the same rate as said first flexible linkage.

9. The drive system of claim 7 wherein said motor is non-backdrivable when the said barrier is stopped at the said closed position and therefore prevents said operator flexible linkage storage unit from rotating and thereby stopping said second flexible linkage from being payed out from said operator flexible linkage storage unit thereby preventing said barrier from being forced open manually.

10. The drive system of claim 7 wherein said operator comprises a clutch, and a tensioning device;

wherein said logic controller engages said clutch when said operator closes said barrier from at or near said open position thereby drivingly connecting said motor to said operator flexible linkage storage unit; and wherein said logic controller disengages said clutch prior to said barrier reaching said closed position thereby disconnecting said motor from said operator flexible linkage storage unit so that said operator flexible linkage storage unit can rotate independently of said motor; and wherein while said clutch is disengaged said operator flexible linkage storage unit is biased by said tensioning device to rotate multiple revolutions to take up and spool said second flexible linkage onto said operator flexible linkage storage unit.

11. The drive system of claim 10 wherein said tensioning device is a power spring.

12. The drive system of claim 10 wherein said clutch is a wrap spring clutch.

* * * * *